United States Patent [19]

Ono et al.

[11] Patent Number: 4,842,985

[45] Date of Patent: Jun. 27, 1989

[54] SILVER HALIDE COLOR PHOTOGRAPHIC MATERIAL

[75] Inventors: Mitsunori Ono; Koji Tamoto; Keiji Mihayashi; Seiji Ichijima; Isamu Itoh; Yoshisada Nakamura, all of Kanagawa, Japan

[73] Assignee: Fuji Photo Film Co., Ltd., Kanagawa, Japan

[21] Appl. No.: 130,127

[22] Filed: Dec. 8, 1987

Related U.S. Application Data

[63] Continuation of Ser. No. 811,913, Dec. 20, 1985, abandoned.

[30] Foreign Application Priority Data

Dec. 27, 1984 [JP] Japan ..... 59-278860

[51] Int. Cl.[4] ..... G03C 5/54; G03C 1/48

[52] U.S. Cl. ..... 430/226; 430/505; 430/506; 430/508; 430/509; 430/553; 430/558; 430/958

[58] Field of Search ..... 430/226, 553, 555, 557, 430/558, 559, 958

[56] References Cited

U.S. PATENT DOCUMENTS

| | | | |
|---|---|---|---|
| 3,725,062 | 4/1973 | Anderson et al. | 430/242 |
| 4,168,976 | 9/1979 | Campbell et al. | 101/464 |
| 4,248,962 | 2/1981 | Lau | 430/382 |
| 4,358,525 | 11/1982 | Mooberry et al. | 430/217 |
| 4,421,845 | 12/1983 | Uemura et al. | 430/544 |
| 4,468,449 | 8/1984 | Arbree et al. | 430/222 |
| 4,500,633 | 2/1985 | Menjo et al. | 430/505 |
| 4,537,853 | 8/1985 | Van de Sande et al. | 430/505 |
| 4,546,073 | 10/1985 | Bergthaller et al. | 430/543 |
| 4,585,728 | 4/1986 | Furutachi et al. | 430/505 |
| 4,711,837 | 12/1987 | Ichijima et al. | 430/548 |

*Primary Examiner*—John L. Goodrow

*Attorney, Agent, or Firm*—Sughrue, Mion, Zinn, Macpeak, and Seas

[57] ABSTRACT

A conventional silver halide color photographic material is described, containing a coupler having a dye moiety having the maximum absorption wave length shifted to a short wave length by a linkage which is cleaved directly or through a timing group by a coupling reaction with the oxidation product of a developing agent and forming a compound or the precursor thereof (compound A) having a dye moiety having the maximum absorption wave length before shifting as the result of the above-described reaction and a compound capable of fixing the hue of the compound A at a long wave length and/or capable of immobilizing the compound A in the photographic layer.

30 Claims, No Drawings

SILVER HALIDE COLOR PHOTOGRAPHIC MATERIAL

This is a continuation of application Ser. No. 811,913 filed Dec. 20, 1985, now abandoned.

FIELD OF THE INVENTION

This invention relates to a silver halide color photographic material and, more particularly, to a conventional silver halide color photographic material containing (1) a coupler having a dye moiety having a shifted maximum absorption wave length and (2) a compound capable of fixing the hue of a compound having a dye moiety having the maximum absorption wave length before shifting, which is formed by the reaction of the coupler and the oxidation product of a developing agent and/or capable of immobilizing the compound in the photographic layer thereof.

BACKGROUND OF THE INVENTION

It is known that by color-developing a silver halide color photographic material, coupler(s) in the photographic material react with an oxidized aromatic primary amino color developing agent to form indophenol, indoaniline, indamine, azomethine, phenoxazine, and similar dyes, whereby color images are formed.

In the system, a subtractive color process is usually used for color reproduction and silver halide emulsions each being selectively sensitive to blue, green or red and yellow, magenta, and cyan color image-forming agents (couplers) which are in complementary color relation with the above-described silver halide emulsions, respectively are used.

Various studies have hitherto been made to bring about improvement of the performance of couplers for forming imaging dyes. As disclosed in many patents and technical literatures, the performance of couplers which are used for the above-described color photographic materials produces large influences on the general photographic performance of the color photographic materials such as sensitivity, color reproducibility, sharpness, etc.; the image quality thereof such as graininess, etc.; and the image storability to heat, light, humidity, etc. For example, if the dye formed by the coupling reaction of a coupler and the oxidation product of a developing agent has a broad spectral absorption width or an unnecessary side absorption, color turbidity occurs to reduce the color reproducibility. Also, as the amount of a dye capable of being formed from a definite amount of coupler is larger, the amount of the coupler to be added to a silver halide emulsion layer can be reduced, which results in reducing the thickness of the emulsion layer, inhibiting the occurrence of color ooze by an optical cause, and improving the sharpness of color images formed. Furthermore, as the stability of the dye formed from a coupler to heat, light, humidity, or ingredients contained in a color photographic material is higher, the storability of the imaging dye is higher. Moreover, as the rate of the coupling reaction of a coupler and the oxidation product of a developing agent is higher, the development proceeds more efficiently and the sensitivity of the light-sensitive material becomes higher.

Practical examples of couplers for improving the photographic performance, as described above are discussed in more detail below.

That is, pyrazolone type couplers capable of forming azomethine dyes having a reduced side absorportion at the short wave length are reported in *Journal of Chemical Society*, Perkin I, page 2047 (1977). Also, bis-type yellow couplers having a reduced molecular weight necessary for forming a definite density of a dye is disclosed in U.S. Pat. No. 4,248,961. Furthermore, couplers giving color images having improved fastness are proposed in U.S. Pat. Nos. 3,311,476 and 4,124,396. Still further, couplers showing a high coloring property useful for increasing the sensitivity are disclosed in U.S. Pat. Nos. 4,296,199 and 4,301,235.

As described above, the improvement of the performance of couplers has recently been proposed but it is not always satisfactory. On the contrary, it can be said to be difficult to remarkedly improve the performance of couplers owing to the restriction inevitably occurring so far as conventional couplers are used. The inevitable restriction of a conventional coupler is that the coupler itself has a function of "receiving an imaging information accumulated in silver halides through the oxidation product of a developing agent to become a chromophore component of imaging dye". Accordingly, the property of the imaging dye formed from a coupler is determined by the molecular structure of the coupler, whereby there are various discrepancies on the construction of coupler molecules.

For example, a coupler having a molecular structure showing a high coupling rate forms an imaging dye having an undesirable spectral absorption or forms an imaging dye having a large side absorption. Also, a coupler capable of forming a dye having high fastness shows a low coupling rate. Furthermore, a coupler forming a dye having a sharp spectral absorption width and less side absorption has a problem as to the stability thereof. In other words, the guide lines for selecting a coupler having an efficient coloring function are not always consistent with the guide lines for selecting a coupler having a function as a desired imaging dye.

Under these circumstances, dye-releasing timing-type couplers have been proposed in Japanese Patent Application (OPI) No. 145135/79 (the term "OPI" as used herein refers to a "published unexamined Japanese patent application") (corresponding to British Patent Application No. 2,010,818A), wherein the hue of an anion structure of a hydroxy-substituted aromatic azo dye formed by development process is utilized.

However, since the pH of a photographic film after being processed by an ordinary development process is weakly acidic, the above-described azo dye released by the coupling reaction of the coupler and the oxidation product of an aromatic primary amine developing agent is partially achromatized by protonation, which results in the reduction of image density. Moreover, since a cation which pairs with the azo dye is a metal ion in the developer, the preservability of the images formed is insufficient. In the invention of the above-described patent application, for solving these problems, a specific process of using a stabilization bath of a high pH (about 11.0) containing cetyltrimethylammonium bromide as a final bath is required for keeping the hue of the azo dye formed. As a result, the above-described invention has problems for practical use.

SUMMARY OF THE INVENTION

A first object of this invention is to provide a color photographic light-sensitive material capable of giving color images having excellent sharpness.

A second object of this invention is to provide a color photographic light-sensitive material with a saved amount of silver.

The above-described objects of this invention can be attained by a conventional silver halide color photographic material containing a coupler having a dye moiety having the maximum absorption wave length shifted to a short wave length by a linkage which is cleaved directly or through a timing group by the coupling reaction with the oxidation product of a developing agent and forming a compound or the precursor thereof (hereinafter, is referred to as compound A) having a dye moiety having maximum absorption wave length before shifting as the result of the aforesaid reaction and a compound (dye-fixing compound) capable of fixing the hue of the compound A at a long wave length and/or capable of immobilizing the compound A in the photographic layer.

DESCRIPTION OF THE PREFERRED EMBODIMENTS

The term "fixing of hue" in this invention means that the hue of aforesaid compound A is shifted to a long wave length at a ratio (not always 100%).

Also, the term "immobilizing compound A in the photographic layer" means that compound A is rendered non-diffusible by an intermolecular interaction, whereby compound A is substantially retained in the photographic layer. Accordingly, the term "immobilizing compound A in the photographic layer" is not always a synonym for the term "fixing of hue".

In this invention, the difference between the maximum absorption wave length before shifting and that after shifting is preferably more than 20 nm., more preferably more than 40 nm.

The term "conventional" in this invention means that compound A formed by photographic processing is utilized in photographic layer(s).

The photographic layer(s) in this invention do not, however, include an image-receiving layer in so-called diffusion transfer process (for example, the image-receiving layers in a peel apart-type film unit as described in U.S. Pat. No. 2,983,606; an integrated-type film unit as described in Japanese Patent Publication Nos. 16356/71, 33697/73, Japanese Patent Application (OPI) No. 13040/75 and British Pat. No. 1,330,524; or a non peel apart-type film unit as described in Japanese Patent Application (OPI) No. 119345/82.

That is, in the silver halide color photographic material of this invention, a peeling operation of a light-sensitive layer from an image-receiving layer (a layer containing a compound capable of fixing the hue of compound A to a long wave length and/or capable of immobilizing compound A in the photographic layer) before, during, and after light exposure and photographic processing is not performed and in the case of not performing such a peeling operation, a light shielding layer and/or a light reflecting layer is not formed between the image-receiving layer and a light-sensitive layer.

The coupler for use in this invention can form two dyes, i.e., an azomethine dye formed by a coupling reaction and a dye formed from a dye moiety having the previously shifted maximum absorption wave length. In this case, two dyes can be utilized for the formation of color images or the azomethine dye formed first is changed into alkali soluble compound and may be dissolved off by a processing liquid at development, or further when a non-coloring coupler residue is used, only the dye formed from a dye moiety having the shifted maximum absorption wave length can be utilized for the formation of color images.

In the case of using the above-described coupler for use in this invention as a color image-forming agent, the coupler is not necessary completely colorless in the state of having the shifted dye moiety. In general, it is convenient to shift the wave length by blocking an auxochrome since in this case, the mole extinction coefficient changes from 1/few to 1/several tens. For example, the coupler for use in this invention can be used for a blue-sensitive emulsion layer as a yellow dye image-forming agent. Also, the couplers for use in this invention can be used for a green-sensitive emulsion layer and a red-sensitive emulsion layer as a magenta dye image-forming agent and a cyan dye image-forming agent, respectively. When the maximum absorption wave length of the magenta dye or the cyan dye is shifted to a short wave length by blocking the dye at the auxochrome, the dye is also provided with a function of a conventional color correction (masking) coupler as a yellow colored coupler or a magenta colored coupler, respectively, which is convenient. In general, a colored coupler is used together with a coupler which is used only for forming color images but the coupler for use in this invention can be used individually. This is because in the case of the shifted dye, such recoloring that the hue of shifted dye is changed into a hue of dye before shifting increases the mole extinction coefficient and hence if the ratio of the mole extinction coefficient of the shifted dye and the dye before shifting matches the mixing ratio of a conventional colored coupler and a colorless color image-forming coupler, it becomes unnecessary to mix other color image-forming couplers with the coupler for use in this invention.

It can be supported by the principle described below that the above-described objects of this invention can be attained by the coupler of this invention.

That is, the coupler for use in this invention can be functionally divided, into a 1st system, where a moiety causes a reaction with the oxidation product of a developing agent and a moiety becomes a dye and a 2nd system, where the coupler can form two dyes with one oxidation product of a developing agent. These two systems are all impossible by conventional couplers and it indicates the excellent effect of this invention that these two systems become possible in the case of using the coupler of this invention.

That is, the structure of the moiety becoming a dye may be determined upon considering the performance of the dye which is formed after the cleavage of a blocking group. Accordingly, the freedom of selecting color images is increased, whereby an unfading dye, a dye having an excellent absorption form, or a dye having a large molecular extinction coefficient can be relatively widely selected. Thus, the improvement of color reproducibility, the improvement of image storability, and the improvement of sharpness by reducing the thickness of photographic layers can be attained.

Furthermore, the structure of the moiety causing a reaction with the oxidation product of a developing agent may be determined by paying attention to the reactivity thereof only. In the case of releasing a dye from a coupler, the dye can be used together with a dye formed from the shifted dye if the color of the dye formed from the coupler by coupling substantially coincides with the aimed color. In this case, in the case of using the coupler of this invention, the addition amount thereof can be greatly reduced as compared with the case of using a conventional color image-forming coupler, whereby the sharpness of color images formed can be improved. On the other hand, even when it becomes necessary to use a coupler mother nucleus forming a dye of a color different from the aimed color by attaching importance to the structure of the coupler capable of increasing the coloring rate, there is no problem in rendering the azomethine dye formed by the coupling, water-soluble and not leaving the dye in the light-sensitive material after processing. Thus, the structure of the color image-forming agent having a high coloring rate can be determined with an increased freedom and a high speed color photographic light-sensitive material is obtained.

Now, "the coupler having a dye moiety having the maximum absorption wave length shifted to a short wave length by a linkage which is cleaved directly or through a timing group by the coupling reaction with the oxidation product of a developing agent and forming a compound or the precursor thereof having a dye moiety having the maximum absorption wave length before shifting as the result of the coupling reaction" for use in this invention includes the couplers represented by the following general formula (I)

$$\text{Cp—(TIME)}_n\text{X—Dye} \qquad \text{(I)}$$

wherein, Cp represents a coupler residue capable of releasing —(TIME)$_n$X—Dye by the coupling reaction with the oxidation product of an aromatic primary amine developing agent; TIME represents a timing group; Dye represents a dye residue; X represents an auxochrome group of said dye; and n represents 0 or positive integer.

In this case, about the coupler residue shown by Cp, there is the case that the coupler residue forms a dye by the coupling reaction with the oxidation product of an aromatic primary amine developing agent and the case that the coupler residue forms a colorless material (so-called non-coloring coupler residue). About Cp, there are a case of having a non-diffusible group, a case of not having a non-diffusible group, and a case of having an alkali-solubilizing group.

When $n \geqq 1$, the timing group shown by TIME is a divalent or tri-valent organic group for linking the coupling portion of Cp and —X—Dye. When $n=0$, —X—Dye is directly bonded to the coupling portion of Cp.

As the mechanism of releasing —X—Dye of the case having TIME, there are those disclosed as photographically useful group (hereinafter, is referred to as PUG) releasing timing-type couplers.

For example, there are a method of releasing PUG by intermolecular nucleophilic replacement reaction after elimination of PUG-containing group from coupler nucleous described in U.S. Pat. No. 4,284,962; a method of releasing PUG by electron transfer along a conjugated system after elimination of PUG-containing group from coupler nucleous described in Japanese Patent Application (OPI) Nos. 114946/81, 154234/82, and 188035/82; a method of releasing PUG by causing an intramolecular nucleophilic replacement reaction by a nucleophilic group newly formed by electron transfer along a conjugated system after elimination of PUG-containing group from coupler nucleous described in Japanese Patent Application (OPI) Nos. 56837/82 and 209740/83; and a method of releasing PUG by the cleavage of hemiacetal after elimination of PUG-containing group from coupler nucleous described in Japanese Patent Application Nos. 75475/84 and 89719/84 (corresponding to Japanese Patent Application (OPI) Nos. 218645/85 and 232549/85, respectively).

The couplers for use in this invention include the couplers having a timing group as shown by the general formula (I) and the couplers having a tri-valent timing group as described below. For example, there is the case that Cp and TIME have linkages at a non-coupling position of Cp as well as at a coupling position of Cp and Cp and TIME have a linkage even after the coupling reaction with the oxidation product of a developing agent and subsequent reaction(s) as described in Japanese Patent Application (OPI) No. 200710/83. Also, the couplers for use in this invention include the case that TIME and Dye further have a linkage which is not cleaved after the coupling reaction with the oxidation product of a developing agent and subsequent reaction(s) as described in Japanese Patent Application Nos. 89719/84, 90437/84, 92556/84 and 92557/84 (corresponding to Japanese Patent Application (OPI) Nos. 232549/85, 233649/85, 237446/85 and 237447/85, respectively). In each of the above-described cases, Cp and Dye may further have therebetween a linkage which is not cleaved even after the coupling reaction with the oxidation product of a developing agent and subsequent reaction(s). Or, in the structure of the general formula (I), Cp and TIME and TIME and Dye may further have therebetween such a non-cleavable linkage.

As the auxochrome residue shown by X, there are hetero atoms such as oxygen atom, nitrogen atom, sulfur atom, etc.

In the dye residue shown by Dye, the maximum absorption wave length thereof is shifted to a short wave length by blocking the auxochromone with Cp or TIME.

These dyes can be selected form those described, for example, in J. Fabian and H. Hartmann, *Light Absorption of Organic Colorants* (published by Springer-Verlag), although the dyes for use in this invention are not restricted to those.

More preferred dyes have a proper hue in the state of releasing the auxochromone therefrom.

Examples of the preferred dyes are hydroxy group-substituted aromatic azo dyes or hydroxy group-substituted heterocyclic aromatic azo dyes represented by the following general formula (II)

$$\text{—X—Y—N=N—Z} \qquad \text{(II)}$$

wherein X has the same significance as defined in the general formula (I); Y represents an atomic group which contains at least one unsaturated bond in a conjugated relation with the azo group and is bonded to X at the atom constituting the unsaturated bond; and Z represents an atomic group containing at least one unsaturated bond capable of being conjugated with the azo group; the total carbon atoms contained in said Y and Z being more than 10.

X in the general formula (II) is preferably an oxygen atom or a sulfur atom.

In the general formula (II), Y and Z are preferably aromatic groups or unsaturated heterocyclic ring groups. As the aromatic groups, substituted or unsubstituted phenyl groups or naphthyl groups are preferred. As the unsaturated heterocyclic ring groups, 4-membered to 7-membered heterocyclic ring groups having a hetero group selected from a nitrogen atom, a sulfur atom, and an oxygen atom are preferred and they may be benzene condensed rings. Examples of the heterocyclic group are groups having a cyclic structure such as pyrrole, thiophene, furan, imidazole, 1,2,4-triazole, oxazole, thiadiazole, pyridine, indole, benzothiophene, benzimidazole, benzoxazole, etc.

Y in the general formula (II) may further have other substituents, in addition of X and the azo group, such as an aliphatic group, an aromatic group, an acyl group, an alkoxycarbonyl group, an aryloxycarbonyl group, an acylamino group, an alkylthio group, an arylthio group, a heterocyclic ring group, a sulfonyl group, a halogen atom, a nitro group, a nitroso group, a cyano group, a carboxy group, a hydroxy group, a sulfonamido group, an alkoxy group, an aryloxy group, an acyloxy group, a carbamoyl group, an amino group, a ureido group, a sulfamoyl group, a carbamoylsulfonyl group, a hydrazinyl group, etc. These groups may be further substituted.

When Z represents a substituted aromatic group or a substituted unsaturated heterocyclic ring group, examples of the substituents are the groups illustrated above as substituents of Y group.

When Y and Z contain an aliphatic group moiety as a substituent, the aliphatic group may be a substituted or unsubstituted, saturated or unsaturated, straight chain or branched, or chain-form or cyclic group having 1 to 32 carbon atoms, preferably 1 to 20 carbon atoms.

When Y and Z have an aromatic group moiety as a substituent, the carbon atom of the aromatic group moiety is 6 to 10 and is preferably a substituted or unsubstituted phenyl group.

Preferred examples of the group shown by the general formula (II) are those represented by following general formulae:

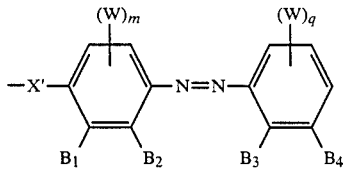
(D-1)

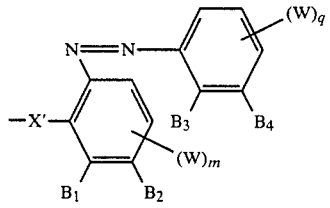
(D-2)

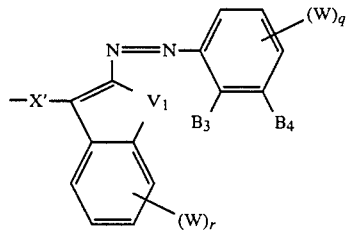
(D-3)

-continued

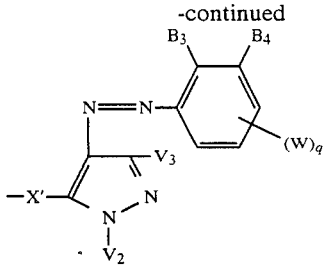
(D-4)

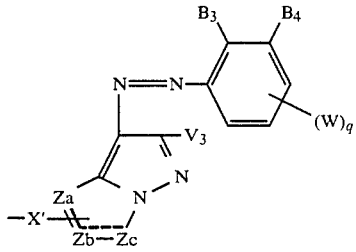
(D-5)

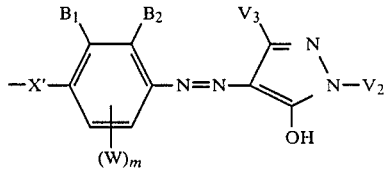
(D-6)

In the above formulae, X' represents an oxygen atom or a sulfur atom; W represents a group selected from the groups illustrated as substituents of Y and Z groups in the general formula (II); m represents 0, 1 or 2; q represents 0, 1, 2 or 3; r represents 0 or an integer of 1 to 4; $B_1$, $B_2$, $B_3$ and $B_4$ each represents a hydrogen atom or the groups explained as W group or the $B_1$ and $B_2$ or the $B_3$ and $B_4$ may combine with each other to form a benzene condensed ring. When they represent a benzene condensed ring, the moiety may be substituted by the groups explained as W group.

In the above-described formulae, when m, q or r represents a number larger than 2, the W's may be the same or different.

In the above formulae, $V_1$ represents an oxygen atom, a sulfur atom, or an imino group which may have a substituent and $V_2$ represents an aliphatic hydrocarbon residue, an aryl group, or a heterocyclic ring residue; when $V_2$ represents an aliphatic hydrocarbon residue, it may be a saturated or unsaturated residue or a straight chain, branched or cyclic residue. Preferably, the residue is an alkyl group having 1 to 22 carbon atoms (e.g., a methyl group, an ethyl group, an isopropyl group, a butyl group, a dodecyl group, an octadecyl group, a cyclohexyl group, etc.), an alkenyl group (e.g., an allyl group, an octenyl group, etc.), etc. Examples of the aryl group are preferably a phenyl group and a naphthyl group and examples of the heterocyclic group are preferably a pyridinyl group, a quinolyl group, a thienyl group, a piperidyl group, an imidazolyl group, etc.

As the substituent introduced into these aliphatic hydrocarbon residue, aryl group, and heterocyclic group, there are the groups illustrated as substituents of Y group in the general formula (II) above.

Also, $V_3$ in the above formulae represents a straight chain or branched alkyl group having 1 to 32 carbon atoms, preferably 1 to 22 carbon atoms, an alkenyl group, a cyclic alkyl group, an aralkyl group, a cyclic alkenyl group, an aryl group, a heterocyclic ring group, an alkoxycarbonyl group (e.g., a methoxycarbonyl group, a stearyloxycarbonyl group, etc.), an aryloxycarbonyl group (e.g., a phenoxycarbonyl group, a naphthoxycarbonyl group, etc.), an aralkyloxycarbonyl group (e.g., a benzyloxycarbonyl group, etc.), an alkoxy group (e.g., a methoxy group, an ethoxy group, a heptadecyloxy group, etc.), an aryloxy group (e.g., a phenoxy group, a trioxy group, etc.), an acylamino group (e.g., an acetylamino group, a 3-[(2,4-di-tert-amylphenoxy)-acetamido]benzamido group, etc.), a diacylamino group, an N-alkylacylamino group (e.g., an N-methylpropionamido group, etc.), an N-arylamylamino group (e.g., an N-phenylacetamido group, etc.), a ureido group (e.g., a ureido group, an N-arylureido group, an N-alkylureido group, etc.), an alkylamino group (e.g., a n-butylamino group, a methylamino group, a cyclohexylamino group, etc.), a cycloamino group (e.g., a piperidino group, a pyridino group, etc.), or a sulfonamido group (e.g., an alkylsulfonamido group, an arysulfonamido group, etc.). These groups may be substituted with the groups illustrated as substituents of Y group in the general formula (II).

$V_3$ in the above-described general formulae also represents a halogen atom (e.g., chlorine atom, bromine atom, etc.) or a cyano group.

Za, Zb and Zc each represents methine, substituted methine, =N— or —NH— and one of a Za-Zb bond and a Zb-Zc bond is a double bond and the other is a single bond. However, it is excluded that Za, Zb and Zc are simultaneously N. When Zb-Zc is a carbon-carbon double bond, it may form a part of an aromatic ring and the aromatic ring be substituted with the groups illustrated as substituents of Y group.

Also, any one of Za, Zb and Zc is bonded to X' to form —X'—C=.

Furthermore, the invention is particularly effective when Cp in the general formula (I) described above is a coupler residue represented by the following general formula (III), (IV), (V), (VI), (VII), (VIII), (IX), (X), (XI), (XII), or (XIII). These couplers have preferably a high coupling speed.

(III)

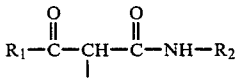

(IV)

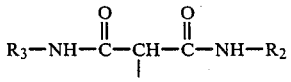

(V)

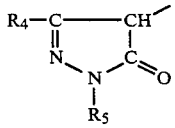

(VI)

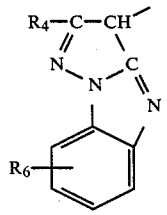

-continued (VII)

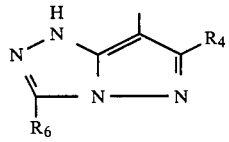

(VIII)

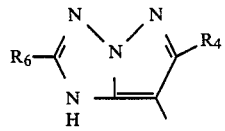

(IX)

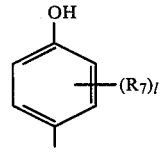

(X)

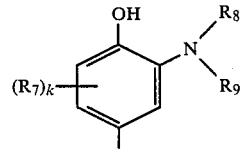

(XI)

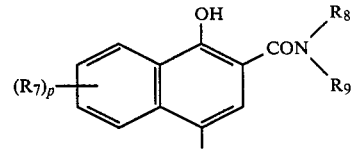

(XII)

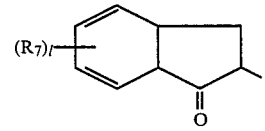

(XIII)

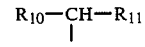

In the above formulae, each free bonding hand disposing at the coupling position shows a bonding position of a coupling releasing group. In the above formulae, when $R_1$, $R_2$, $R_3$, $R_4$, $R_5$, $R_6$, $R_7$, $R_8$, $R_9$, $R_{10}$ or $R_{11}$ has a non-diffusible group, it is selected such that the total carbon atom numbers thereof are 8 to 32, preferably 10 to 22 and in other cases than the above case, it is preferred that the total carbon atom number thereof is 15 or less.

$R_1$ to $R_{11}$, l, k and p in the general formulae (III) to (XIII) described above are explained below.

In the general formula (III), $R_1$ represents an aliphatic group, an aromatic group, an alkoxy group or a heterocyclic group and in the general formulae (III) and (IV), $R_2$ and $R_3$ each represents an aromatic group or a heterocyclic group.

The aliphatic group shown by $R_1$ in the general formula (III) is preferably an aliphatic group having 1 to 22 carbon atoms, which may be substituted or unsubstituted, or may be a chain form or a cyclic form. In the case of the substituted aliphatic group, the preferred substituents are an alkoxy group, an aryloxy group, an amino group, an acylamino group, a halogen atom, etc., and the aforesaid groups as substituents may further have a substituent.

Practical examples of the aliphatic group useful as $R_1$ are an isopropyl group, an isobutyl group, a tert-butyl group, an isoamyl group, a tert-amyl group, a 1,1-dimethylbutyl group, a 1,1-dimethylhexyl group, a 1,1-diethylhexyl group, a dodecyl group, a hexadecyl group, an octadecyl group, a cyclohexyl group, a 2-methoxyisopropyl group, a 2-phenoxyisopropyl group, a 2-p-tert-butylphenoxyisopropyl group, an α-aminoisopropyl group, an α-(diethylamino)isopropyl group, an α-(succinimido)isopropyl group, an α-(phthalimido)isopropyl group, an α-(benzenesulfonamido)isopropyl group, etc.

When $R_1$, $R_2$, or $R_3$ in the above-described formulae represents an aromatic group (in particular, a phenyl group), the aromatic group may be substituted. For example, an aromatic group such as a phenyl group may be substituted by an alkyl group having less than 32 carbon atoms, an alkenyl group, an alkoxy group, an alkoxycarbonyl group, an alkoxycarbonylamino group, an aliphatic amido group, an alkylsulfamoyl group, an alkylsulfonamido group, an alkylureido group, an alkyl-substituted succinimido group, etc. In this case, the aforesaid alkyl group may have an aromatic group such as a phenylene group in the chain thereof. Furthermore, the above-described aromatic group may be substituted with an aryloxy group, an aryloxycarbonyl group, an arylcarbamoyl group, an arylamido group, an arylsulfamoyl group, an arylsulfonamido group, an arylureido group, etc. The aryl moiety of the aforesaid substituent may be further substituted with at least one alkyl group total carbon atom number of which is 1 to 22.

The phenyl group shown by $R_1$, $R_2$, or $R_3$ in the general formulae (III) and (IV) may be substituted with an amino group, a hydroxy group, a carboxy group, a sulfo group, a nitro group, a cyano group, a thiocyano group or a halogen atom and the aforesaid groups as the substituents may be further substituted with a lower alkyl group having 1 to 6 carbon atoms.

Also, $R_1$, $R_2$, or $R_3$ may represent a substituent composed of a phenyl group condensed with other ring, such as a naphthyl group, a quinolyl group, an isoquinolyl group, a chromanyl group, a coumaranyl group, a tetrahydronaphthyl group, etc., and these substituents may further have a substituent.

When $R_1$ represents an alkoxy group, the alkyl moiety of the alkoxy group is a straight chain or branched alkyl group having 1 to 32, preferably 1 to 22 carbon atoms, an alkenyl group, a cyclic alkyl group or a cyclic alkenyl group and these groups may further be substituted with a halogen atom, an aryl group or an alkoxy group.

When $R_1$, $R_2$, or $R_3$ represents a heterocyclic group, the heterocyclic group is bonded to the carbon atom of a carbonyl group of the acyl group or the nitrogen atom of the amino group in an α-acylacetamido group through one of the carbon atoms forming the heterocyclic ring. Examples of such a heterocyclic ring are thiophene, furan, pyrrole, pyrazole, pyridine, pyrazine, pyrimidine, pyridazine, indolizine, imidazole, thiazole, oxazole, triazine, thiadiazine, oxazine, etc. They have further a substituent on the ring.

$R_5$ in the general formula (V) described above represents a straight chain or branched alkyl group having 1 to 32, preferably 1 to 22 carbon atoms (e.g., a methyl group, an isopropyl group, a tert-butyl group, a hexyl group, a dodecyl group, etc.), an alkenyl group (e.g., an allyl group, etc.), a cyclic alkyl group (e.g., a cyclopentyl group, a cyclohexyl group, a norbornyl group, etc.), an aralkyl group (e.g., a benzyl group, a β-phenylethyl group, etc.), or a cyclic alkenyl group (e.g., a cyclopentenyl group, a cyclohexenyl group, etc.), and these groups may be substituted by a halogen atom, a nitro group, a cyano group, an aryl group, an alkoxy group, an aryloxy group, a carboxy group, an alkylthiocarbonyl group, an arylthiocarbonyl group, an alkoxycarbonyl group, an aryloxycarbonyl group, a sulfo group, a sulfamoyl group, a carbamoyl group, an acylamino group, a diacylamino group, a ureido group, a urethane group, a thiourethane group, a sulfonamido group, a heterocyclic group, an arylsulfonyl group, an alkylsulfonyl group, an arylthio group, an alkylthio group, an alkylamino group, a dialkylamino group, an anilino group, an N-arylanilino group, an N-alkylanilino group, an N-acylanilino group, a hydroxy group, a mercapto group, etc.

Furthermore, $R_5$ may represents an aryl group (e.g., a phenyl group, an α- or β-naphthyl group, etc.). The aryl group may have one or more substituents such as an alkyl group, an alkenyl group, a cyclic alkyl group, an aralkyl group, a cyclic alkenyl group, a halogen atom, a nitro group, a cyano group, an aryl group, an alkoxy group, an aryloxy group, a carboxy group, an alkoxycarbonyl group, an aryloxycarbonyl group, a sulfo group, a sulfamoyl group, a carbamoyl group, an acylamino group, a diacylamino group, a ureido group, an urethane group, a sulfonamido group, a heterocyclic group, an arylsulfonyl group, an alkylsulfonyl group, an arylthio group, an alkylthio group, an alkylamino group, a dialkylamino group, an anilino group, an N-alkylanilino group, an N-arylanilino group, an N-acylanilino group, a hydroxy group, a mercapto group, etc. $R_5$ is more preferably a phenyl group at least one of the ortho-position of which is substituted with an alkyl group, an alkoxy group, a halogen atom, etc., and this case advantageously causes less coloring of couplers remaining in photographic layers in the photographic material by light and heat.

Furthermore, $R_5$ may represents a heterocyclic ring (e.g., a 5-membered or 6-membered heterocyclic ring or a condensed heterocyclic ring group containing a nitrogen atom, an oxygen atom or a sulfur atom as the hetero atom, such as a pyridyl group, a quinolyl group, a furyl group, a benzothiazolyl group, an oxazolyl group, an imidazolyl group, a naphthoxazolyl group, etc.), a heterocyclic group substituted with the groups illustrated as substituent of the above-described aryl group, an aliphatic acyl group, an aromatic acyl group, an alkylsulfonyl group, an arylsulfonyl group, an alkylcarbamoyl group, an arylcarbamoyl group, an alkylthiocarbamoyl group, or an arylthiocarbamoyl group.

$R_4$ is the general formulae (V) to (VII) described above represents a hydrogen atom, a straight chain or branched alkyl group having 1 to 32, preferably 1 to 22 carbon atoms, an alkenyl group, a cyclic alkyl group, an aralkyl group, a cyclic alkenyl group (which may be substituted with the groups illustrated above as substituent of $R_5$ group), an alkoxycarbonyl group (e.g., a methoxycarbonyl group, an ethoxycarbonyl group, a stearyloxycarbonyl group, etc.), an aryloxycarbonyl group (e.g., a phenoxycarbonyl group, a naphthoxycarbonyl group, etc.), an aralkyloxycarbonyl group (e.g., benzyloxycarbonyl group, etc.), an alkoxy group (e.g., a methoxy group, an ethoxy group, a heptadecyloxy group, etc.), an aryloxy group (e.g., a phenoxy group, a tolyloxy group, etc.), an alkylthio group (e.g., an ethylthio group, a dodecylthio group, etc.), an arylthio group (e.g., a phenylthio group, an α-naphthylthio group, etc.), a carboxy group, an acylamino group (e.g., an acetylamino group, a 3-[(2,4-di-tert-amylphenoxy)acetamido]benzamido group, etc.), a diacylamino group, an N-alkylacylamino group (e.g., an N-methylpropylamido group, etc.), an N-arylacylamino group (e.g., an N-phenylacetamido group, etc.), a ureido group (e.g., a ureido group, an N-arylureido group, an N-alkylureido group, etc.), a urethane group, a thiourethane group, an arylamino group (e.g., a phenylamino group, an N-methylanilino group, a diphenylamino group, an N-acetylanilino group, a 2-chloro-5-tetradecanamidoanilino group, etc.), an alkylamino group (e.g., an n-butylamino group, a methylamino group, a cyclohexylamino group, etc.), a cycloamino group (e.g., a piperidino group, a pyrrolidino group, etc.), a heterocyclic amino group (e.g., a 4-pyridylamino group, a 2-benzoxazolylamino group, etc.), an alkylcarbonyl group (e.g., a methylcarbonyl group, etc.), an arylcarbonyl group (e.g., a phenylcarbonyl group, etc.), a sulfonamido group (e.g., an alkylsulfonamido group, an arylsulfonamido group, etc.), a carbamoyl group (e.g., an ethylcarbamoyl group, a dimethylcarbamoyl group, an N-methyl-phenylcarbamoyl group, an N-phenylcarbamoyl group, etc.), a sulfamoyl group (e.g., an N-alkylsulfamoyl group, an N,N-dialkylsulfamoyl group, an N-arylsulfamoyl group, an N-alkyl-N-arylsulfamoyl group, an N,N-diarylsulfamoyl group, etc.), a cyano group, a hydroxy group, a mercapto group, a halogen atom or a sulfo group.

$R_6$ in the general formula (VI) to (VIII) described above represents a hydrogen atom, a straight chain or branched alkyl group having 1 to 32, preferably 1 to 22 carbon atoms, an alkenyl group, a cyclic alkyl group, an aralkyl group, or a cyclic alkenyl group and these groups may be substituted with the groups illustrated above as substituent of $R_5$ group.

Also, $R_6$ may represents an aryl group or a heterocyclic group and these groups may be substituted with the groups illustrated above as substituent of $R_5$ group.

Furthermore, $R_6$ may represents a cyano group, an alkoxy group, an aryloxy group, a halogen atom, a carboxy group, an alkoxycarbonyl group, an aryloxycarbonyl group, an acyloxy group, a sulfo group, a sulfamoyl group, a carbamoyl group, an acylamino group, a diacylamino group, a ureido group, a urethane group, a sulfonamido group, an arylsulfonyl group, an alkylsulfonyl group, an arylthio group, an alkylthio group, an alkylamino group, a dialkylamino group, an anilino group, an N-arylanilino group, an N-alkylanilino group, an N-acylanilino group, a hydroxy group, or a mercapto group.

$R_7$, $R_8$ and $R_9$ shown by the general formula (IX) to (XII) each represents a group usually used for four-equivalent phenol or α-naphthol coupler.

Practical examples of $R_7$ are a hydrogen atom, a halogen atom, an alkoxycarbonylamino group, an aliphatic hydrocarbon residue, an N-arylureido group, an acylamino group or a group shown by —O—$R_{12}$ or —S—$R_{12}$ (wherein, $R_{12}$ represents an aliphatic hydrocarbon residue). When two or more $R_7$'s exist in one molecule, they may be the same or different and the aliphatic hydrocarbon residue includes those having a substituent.

Also, these substituents have an aryl group as a substituent, the aryl group may be substituted with the groups illustrated above as substituent of $R_5$ group.

$R_8$ and $R_6$ may be a group selected from an aliphatic hydrocarbon residue, an aryl group and a heterocyclic residue, or one of these groups may be a hydrogen atom and also these groups may have a substituent. Also, $R_8$ and $R_9$ may form a nitrogen heterocyclic nucleus together therewith.

The aforesaid aliphatic hydrocarbon residue may be a saturated or unsaturated residue or a straight chain, branched or cyclic residue. Preferred examples of the aliphatic hydrocarbon group are alkyl groups (e.g., a methyl group, an ethyl group, a propyl group, an isopropyl group, a butyl group, a t-butyl group, an isobutyl group, a dodecyl group, an octadecyl group, a cyclobutyl group, a cyclohexyl group, etc.), and alkenyl groups (e.g., an allyl group, an octenyl group, etc.).

Examples of the aforesaid aryl group are a phenyl group, a naphthyl group, etc. Also, examples of the heterocyclic residue are a pyridinyl group, a quinolyl group, a thienyl group, a piperidyl group, a imidazolyl group, etc.

The aforesaid aliphatic hydrocarbon residue, the aryl group, and the heterocyclic residue shown by $R_8$ and $R_9$ may have a substituent such as a halogen atom, a nitro group, a hydroxy group, a carboxy group, an amino group, a substituted amino group, a sulfo group, an alkyl group, an alkenyl group, an aryl group, a heterocyclic group, an alkoxy group, an aryloxy group, an arylthio group, an arylazo group, an acylamino group, a carbamoyl group, an ester group, an acyl group, an acyloxy group, a sulfonamido group, a sulfamoyl group, a sulfonyl group, a morpholino group, etc.

Also, in the above-described general formulae (IX) to (XII), l represents an integer of 1 to 4, k represents an integer of 1 to 3, and p represents an integer of 1 to 5.

$R_{10}$ in the general formula (XIII) above represents an arylcarbonyl group, an alkanoyl group having 2 to 32, preferably 2 to 22 carbon atoms, an arylcarbamoyl group, an alkanecarbamoyl group having 2 to 32, preferably 2 to 22 carbon atoms, an alkoxycarbonyl group having 1 to 32, preferably 1 to 22 carbon atoms, or an aryloxycarbonyl group. These groups may have a substituent such as an alkoxy group, an alkoxycarbonyl group, an acylamino group, an alkylsulfamoyl group, an alkylsulfonamido group, an alkylsuccinimido group, a halogen atom, a nitro group, a carboxy group, a nitryl group, an alkyl group, an aryl group, etc.

$R_{11}$ in the above-described general formula (XIII) represents an arylcarbonyl group, an alkanoyl group having 2 to 32, preferably 2 to 22 carbon atoms, an arylcarbamoyl group, an alkanecarbamoyl group having 2 to 32, preferably 2 to 22 carbon atoms, an alkoxycarbonyl group having 1 to 32, preferably 1 to 22 carbon atoms, an aryloxycarbonyl group, an alkanesulfonyl group having 1 to 32, preferably 1 to 22 carbon atoms, an arylsulfonyl group, an aryl group, or a 5-membered or 6-membered heterocyclic group (having a nitrogen atom, an oxygen atom or a sulfur atom as a hetero atom, such as a triazolyl group, an imidazolyl group, a phthalimido group, a succinimido group, a furyl group, a puridyl group, or a benzotriazolyl group) and these groups may be substituted with the groups illustrated above as substituent of $R_{10}$ group.

As described above, when Cp in the general formula (I) has a non-diffusible group, the coupler of the general formula forms a non-diffusible colored or colorless compound after the coupling reaction with the oxidation product of an aromatic primary amine developing agent and when Cp has a diffusible group, the compound formed by the coupling reaction has diffusibility according to the diffusible group included in Cp. Furthermore, when Cp has an alkali solubilizing group, the compound formed by the coupling reaction is dissolved off from the photographic film.

The coupler of this invention shown by the general formula (I) above includes the case that the coupler is a polymer. That is, the coupler may be a polymer derived from a monomer coupler represented by the following general formula (XIV) and having a recuring unit represented by the general formula (XV) or may be a copolymer of the above-described monomer coupler and at least one of a non-coloring monomer having at least one ethylene group having no coupling ability with the oxidation product of an aromatic primary amine developing agent. In this case, two or more kinds of the monomer couplers may be simultaneously polymerized.

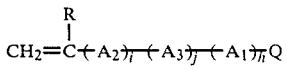

(XIV)

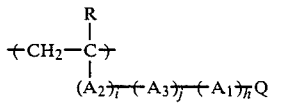

(XV)

wherein, R represents a hydrogen atom, a lower alkyl group having 1 to 4 carbon atoms or a chlorine atom; $A_1$ represents —CONH—, —NHCONH—, —NHCOO—, —COO—, —$SO_2$—, —CO—, —NHCO—, —$SO_2$NH—, —NH$SO_2$—, —OCO—, —OCONH—, —NH— or —O—; $A_2$ represents —CONH— or —COO—; $A_3$ represents a substituted or unsubstituted alkylene group having 1 to 10 carbon atoms, a substituted or unsubstituted aralkylene group, or a substituted or unsubstituted arylene group.

The alkylene group may be a straight chain or branched alkylene group such as a methylene group, a methylmethylene group, a dimethylmethylene group, a dimethylene group, a trimethylene group, a tetramethylene group, a pentamethylene group, a hexamethylene group, a decylmethylene group, etc. Examples of the aralkylene group are a benzylidene group, etc. Examples of the arylene group are a phenylene group, a naphthylene group, etc.

Q in the aforesaid general formulae represents a residue of the coupler shown by the general formula (I) and may be bonded through any moiety of Cp, TIME or Dye in the general formula (I).

Also, i, j, and h represents 0 or 1 excluding the case that i, j, and h are simultaneously 0.

Examples of the substituent of the alkylene group, aralkylene group, arylene group shown by $A_3$ are an aryl group (e.g., a phenyl group, etc.), a nitro group, a hydroxy group, a cyano group, a sulfo group, an alkoxy group (e.g., a methoxy group, etc.), an aryloxy group (e.g., a phenoxy group, etc.), an acyloxy group (e.g., an acetoxy group, etc.), an acylamino group (e.g., an acetylamino group, etc.), a sulfonamido group (e.g., a methanesulfonamido group, etc.), a sulfamoyl group (e.g., a methylsulfamoyl group, etc.), a halogen atom (e.g., fluorine, chlorine, bromine, etc.), a carboxy group, a carbamoyl group (e.g., a methylcarbamoyl group, etc.), an alkoxycarbonyl group (e.g., a methoxycarbonyl group, etc.), a sulfonyl group (e.g., a methylsulfonyl group, etc.), etc. When the group shown by $A_3$ has two or more substituents, they may be the same or different.

Then, as the non-coloring ethylenic monomer which does not cause coupling with the oxidation product of an aromatic primary amine developing agent, there are acrylic acid, α-chloroacrylic acid, α-alkylacrylic acid, the esters or amides derived from these acrylic acids, methylenebisacrylamide, vinyl ester, acrylonitrile, an aromatic vinyl compound, a maleic acid derivative, a vinylpyridine, etc. In this case, two or more such non-coloring ethylenically unsaturated monomers can be used.

It is preferably that the hue of the compound A is substantially the same as the hue of dye formed by coupling reaction between the coupler of the present invention and the oxidation product of aromatic primary amine developing agent.

When the coupler of the present invention is represented by the general formula (I), it is preferred that when Cp in the general formula (I) represents a coupler residue represented by the general formula (III) or (IV), the maximum absorption wave length of the compound A formed is fallen within the range of from 400 to 480 nm; when Cp in the general formula (I) represents a coupler residue represented by the general formula (V), (VI), (VII) or (VIII), the maximum absorption wave length of the compound A formed is fallen within the range of from 510 to 590 nm; and when Cp in the general formula (I) represents a coupler residue represented by the general formula (X) or (XI), the maximum absorption wave length of the compound A formed is fallen within the range of from 600 to 700 nm. It is more preferred that Cp in the general formula (I) represents the coupler residue represented by the general formula (III), (IV), (X) or (XI), and it is particularly preferred that Cp in the general formula (I) represents the coupler residue represented by the general formula (III) or (IV).

The above-described coupler of this invention is added to a light-sensitive silver halide emulsion layer or the adjacent layer thereof.

The addition amount of the coupler is 0.001 to 1 mole, preferably 0.005 to 0.5 mole per mole of silver contained in a light-sensitive silver halide emulsion layer in the case of adding to the silver halide emulsion layer or per mole of silver halide contained in the adjacent layer in the case of adding to the adjacent layer.

Practical example of the preferred couplers of this invention shown by the general formula (I) are shown below but they are not limited to those materials.

Examples of the coupler of the general formula (I) giving a yellow dye by cleaving the bond between TIME (when $n \geqq 1$) or Cp (when $n=0$) and X in the general formula (I).

Y-1
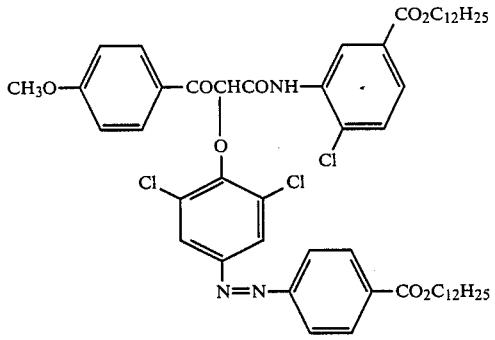
Y-2
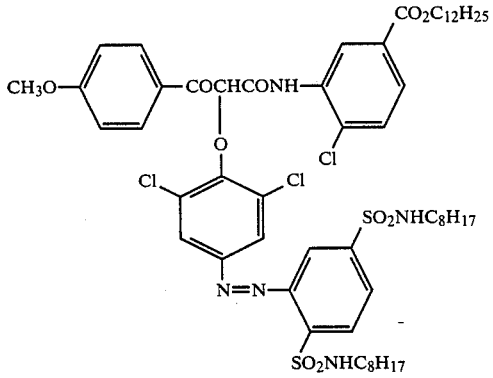
Y-3
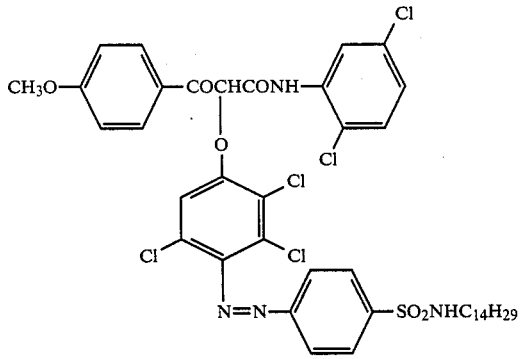
Y-4
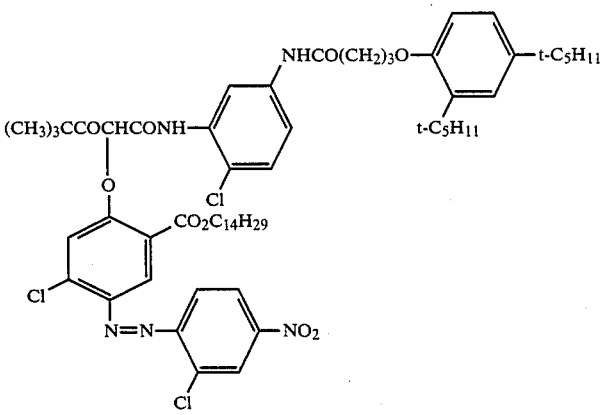

-continued
Y-5
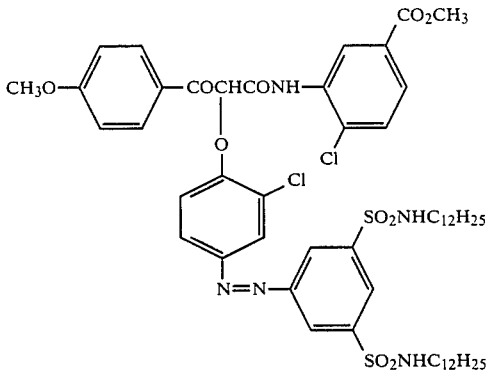
Y-6
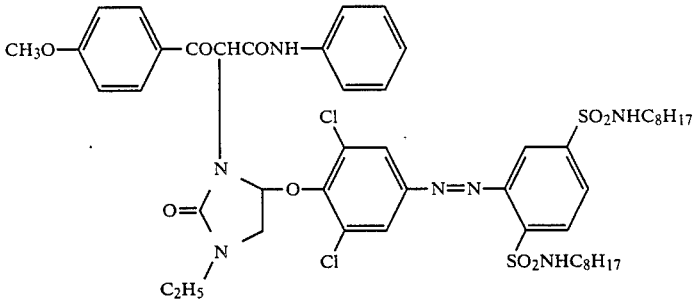
Y-7
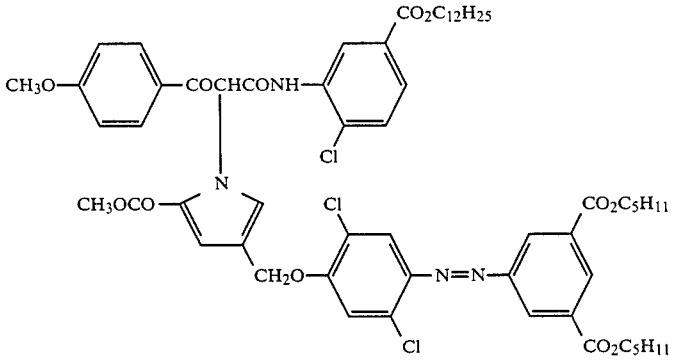
Y-8
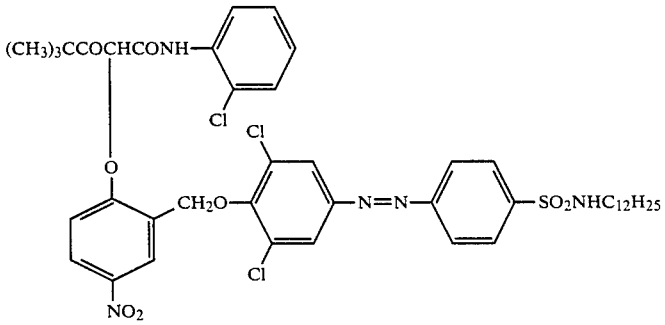

-continued
Y-9
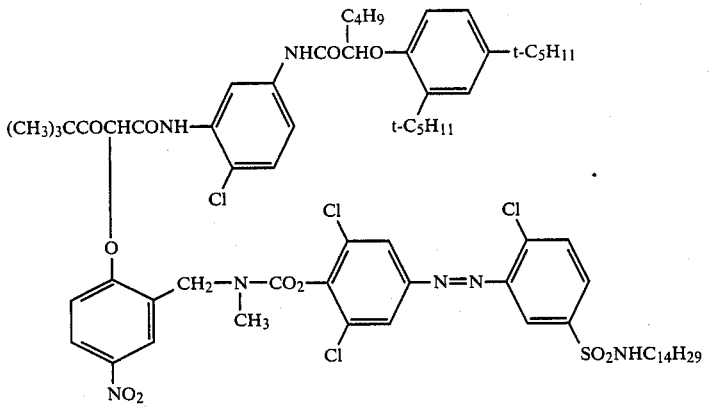
Y-10
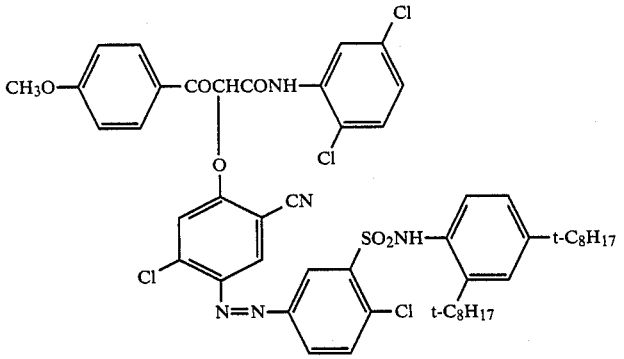
Y-11
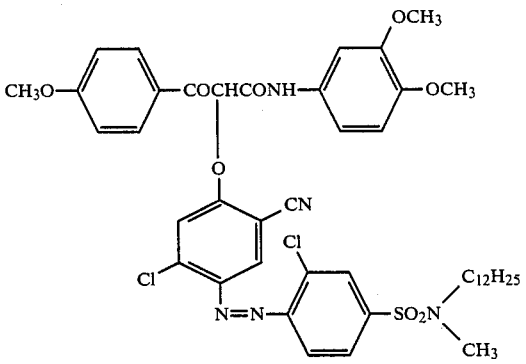
Y-12
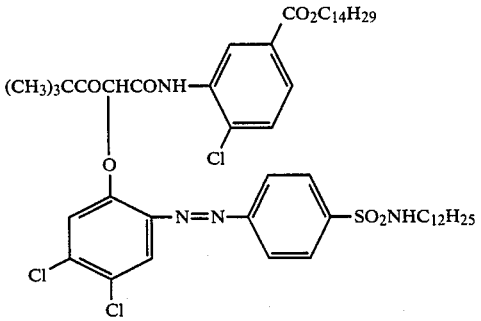

-continued
Y-13
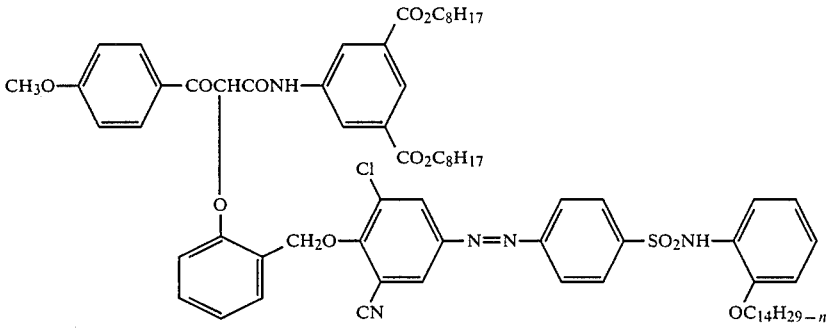
Y-14
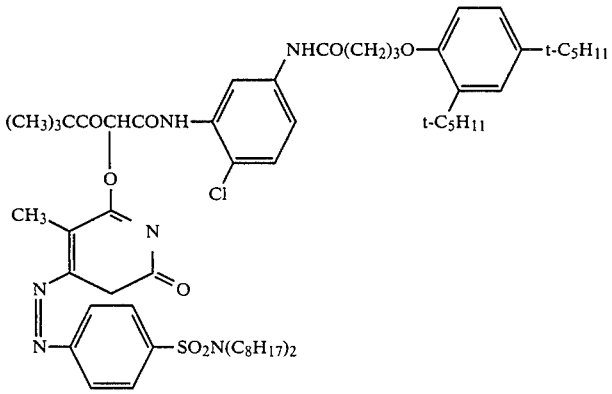
Y-15
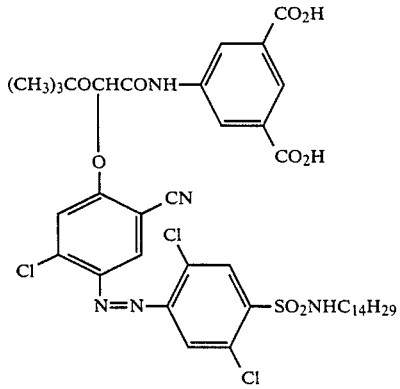

-continued
Y-16
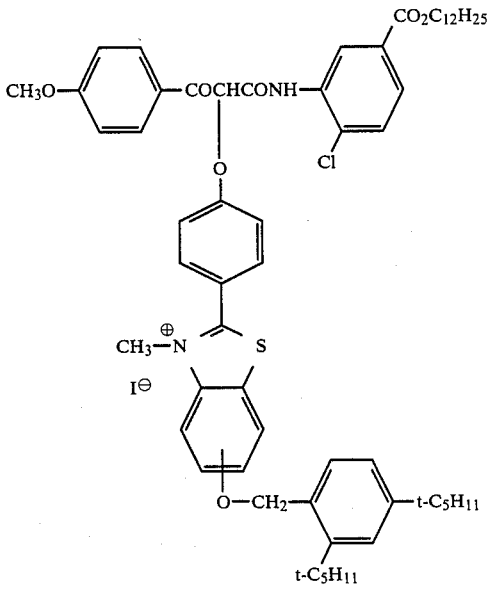
Y-17
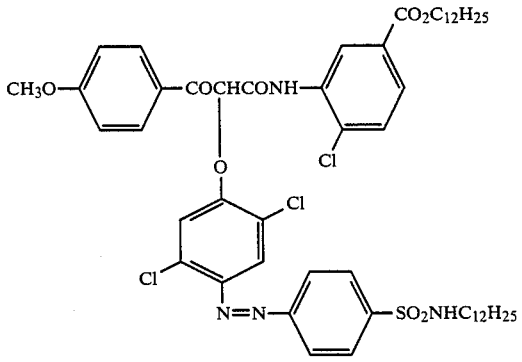
Y-18
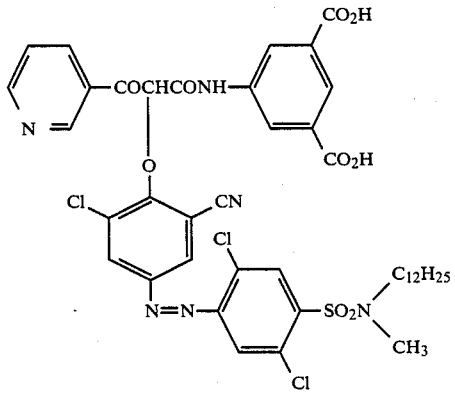

-continued
Y-19
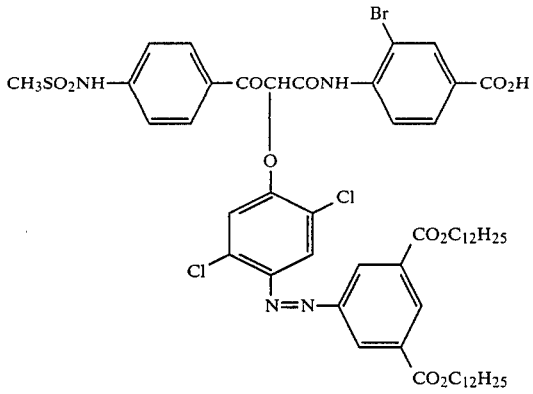
Examples of the coupler shown by the general formula (I) giving a magenta coupler by cleaving by the bond between TIME (when n≧1) or Cp (when n=0) and X in the general formula (I):
M-1
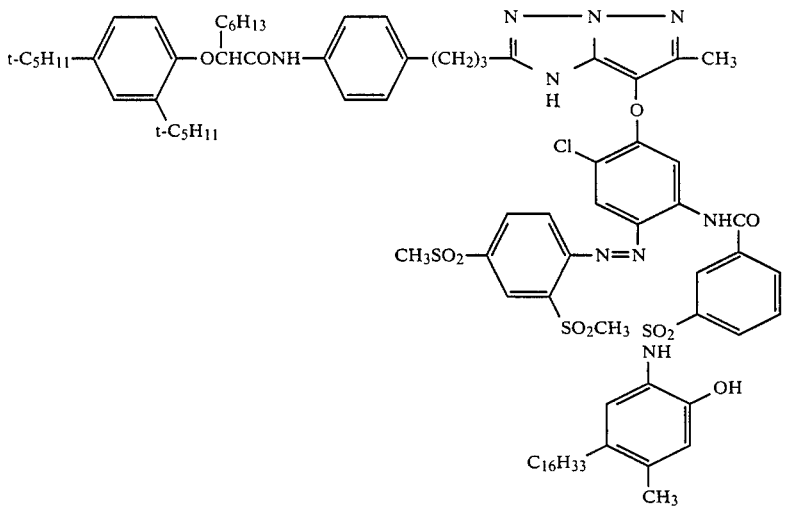
M-2
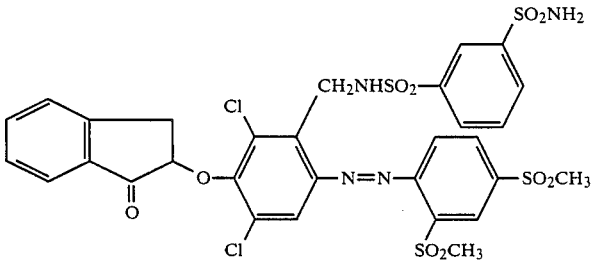
M-3
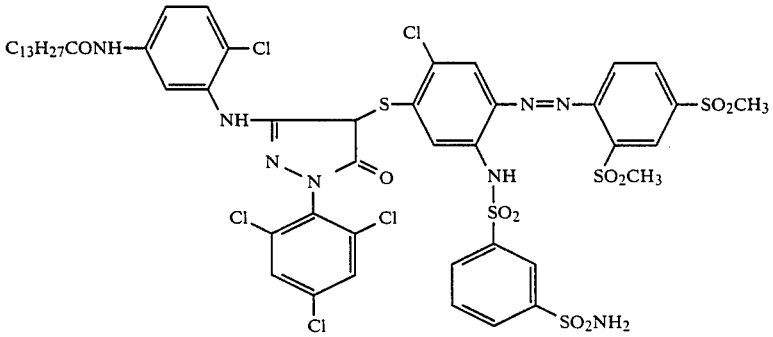

-continued
M-4
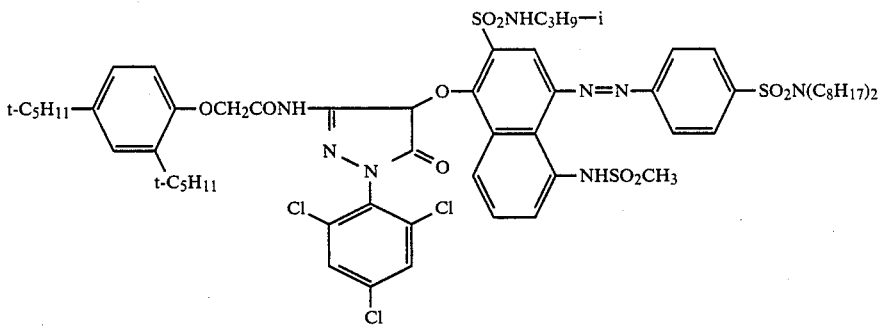
M-5
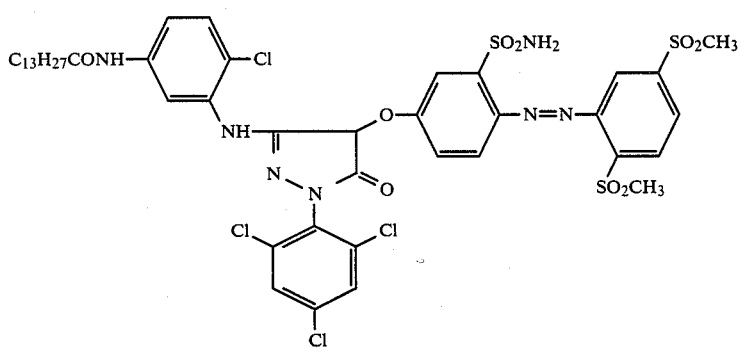
M-6
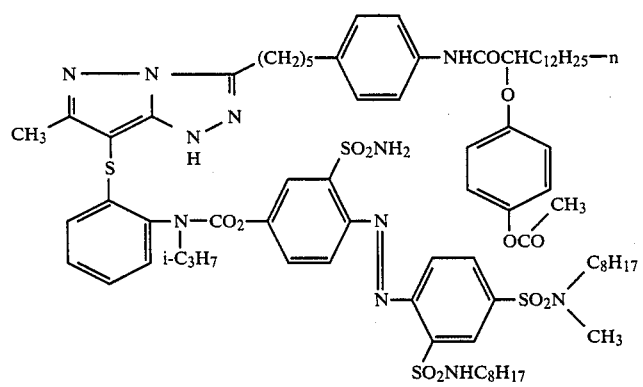
M-7
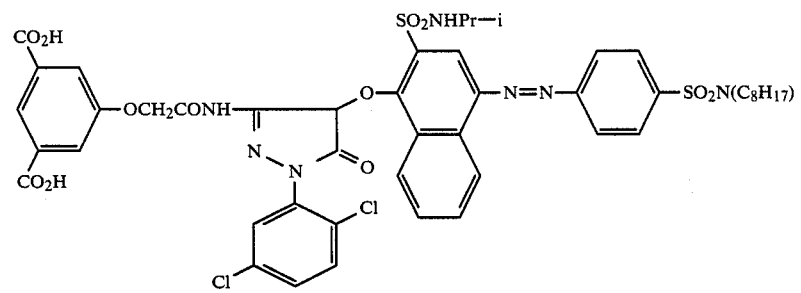
Examples of the coupler shown by the general formula (I) giving a cyan dye by cleaving the bond between TIME (when n≧1) or Cp (when n=0) and X in the general formula (I):

C-1
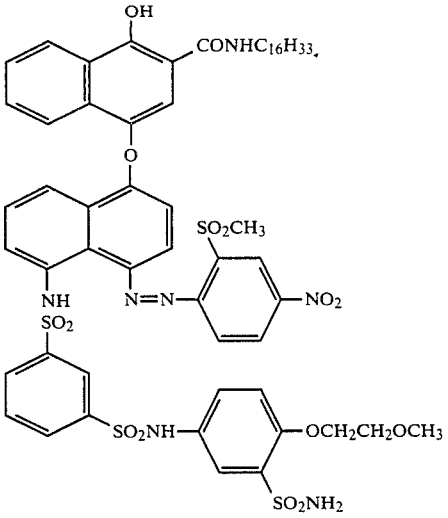
C-2
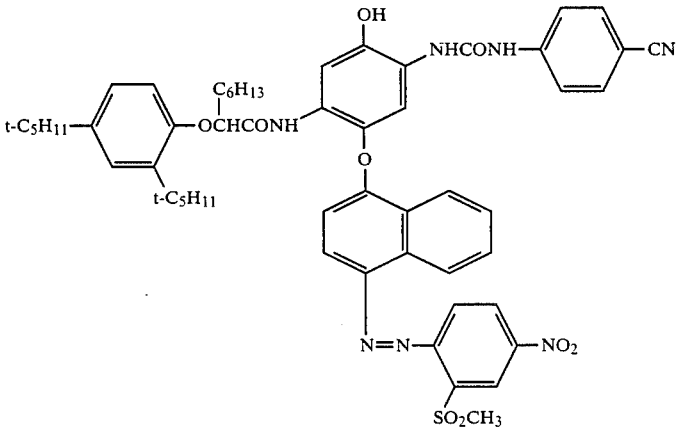
C-3
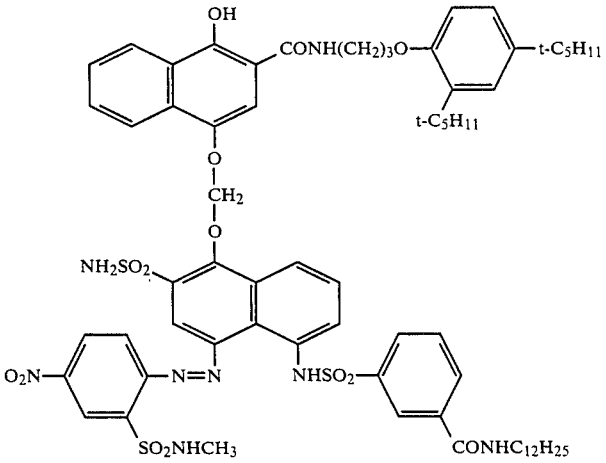

-continued
C-4
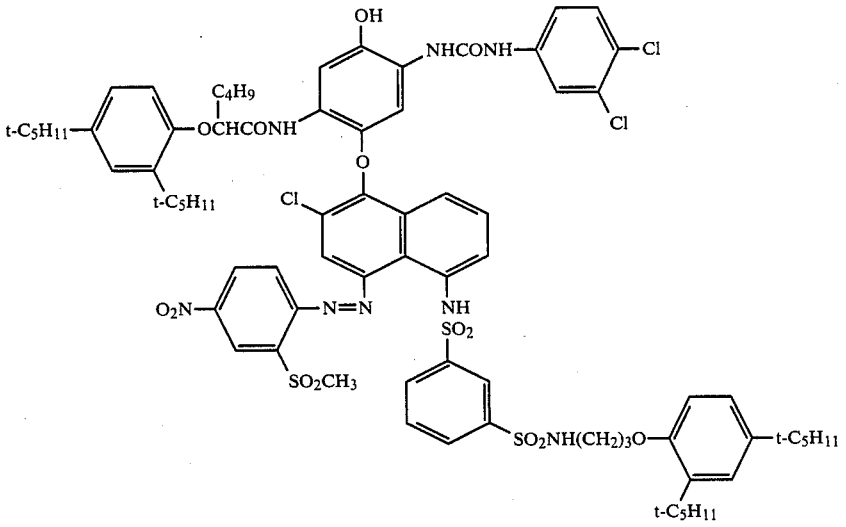
C-5
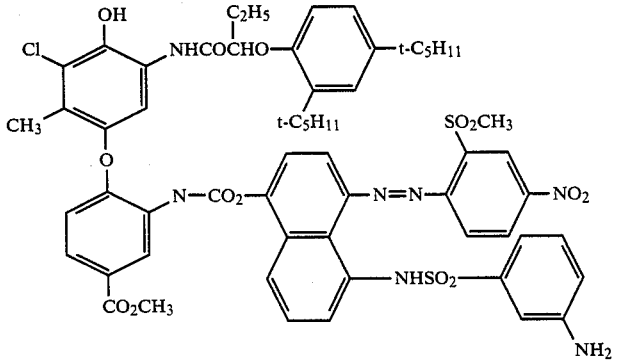
C-6
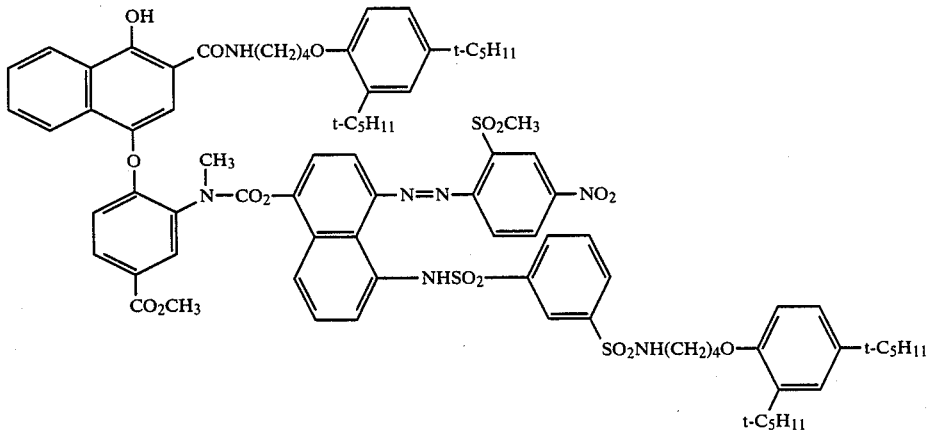

-continued

C-7

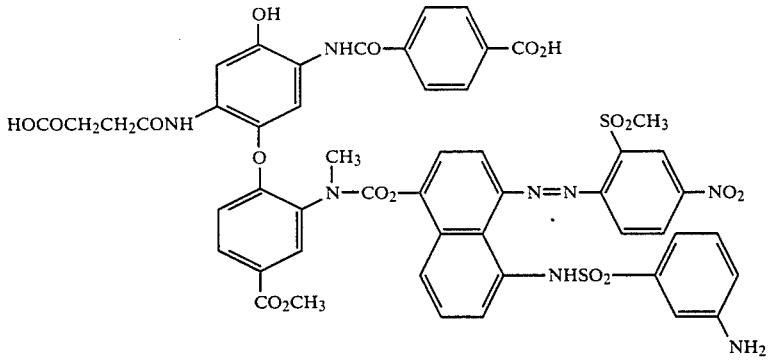

Then, synthesis examples for the couplers of this invention shown by the general formula (I) are practically explained below.

SYNTHESIS EXAMPLE 1

Synthesis of Coupler (Y-3)

In 400 ml of toluene were suspended 37 g (0.1 mole) of compound 1 shown below and 57 g (0.1 mole) of compound 2 shown below and after adding thereto 14 g (0.1 mole) of anhydrous potassium carbonate, the mixture was refluxed for 4 hours. After distilling off the solvent from the reaction mixture under reduced pressure, the residue formed was dissolved in ethyl acetate and the solution was repeatedly washed with an aqueous 2% hydrochloric acid solution and then washed with water. Thereafter, the organic layer formed was collected and concentrated under reduced pressure to provide 86 g of a solid material, which was crystallized by use of ethyl acetate/n-hexane (1:3, vol/vol) and thereafter recrystallized from the solvent mixture to provide 61 g of desired coupler (Y-3).

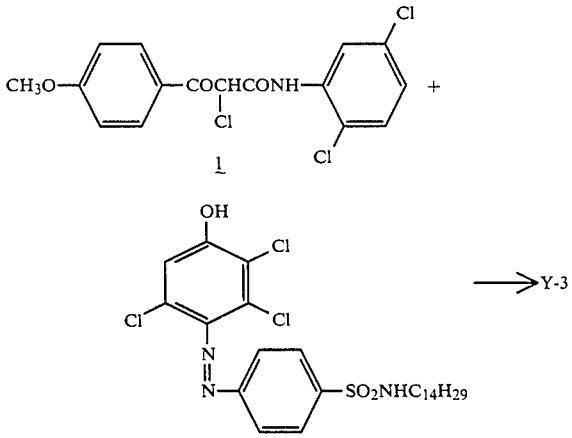

SYNTHESIS EXAMPLE 2

Synthesis of Coupler (Y-12)

In 200 ml of N,N-dimethylacetamide were dissolved 26 g (0.05 mole) of compound 3 and 25 g (0.05 mole) of compound 4 and after adding thereto 5.6 g (0.05 mole) of tert-butoxy potassium, the mixture was stirred for 5 hours at 60° C. The reaction mixture thus obtained was cooled to room temperature and after adding thereto 1 liter of ethyl acetate, the mixture was washed with 1 liter of water. Then, after neutralizing the mixture with diluted hydrochloric acid, the mixture was further washed with 1 liter of water. The organic layer thus formed was collected, dried, and the solvent was distilled off to provide 58 g of a residue, which was separated and purified by silica gel chromatography (developing with a mixed solvent of ethyl acetate and hexane of 1:4) to provide 21 g of desired coupler (Y-12).

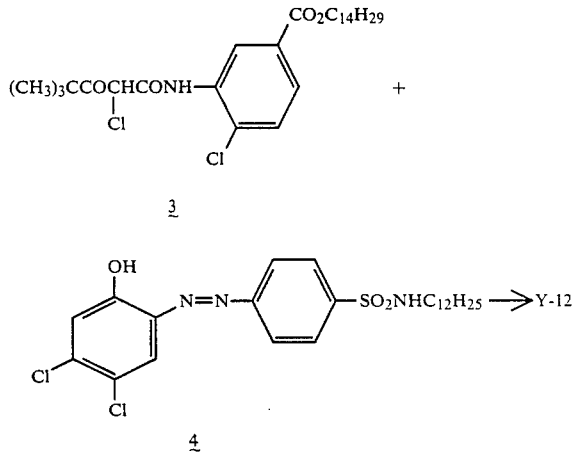

SYNTHESIS EXAMPLE 3

Synthesis of Coupler (M-2)

In 500 ml of a mixture of desicated dimethylformamide and tetrahydrofuran in 1:1 by volume ratio was dissolved 26 g (0.05 mole) of compound 5 shown below and the solution was stirred under ice-cooling. To the solution was added 5.5 g (0.05 mole) of tert-butoxy potassium and after stirring the mixture at room temperature, 60 ml of dimethylformamide solution of 11 g (0.05 mole) of compound 6 was gradually added thereto at room temperature. Furthermore, after stirring for 1.5 hours, the mixture was poured into 2 liters of ice-water to form 33 g of crude crystals, which were collected and recrystallized twice from a mixture of ethyl acetate and n-hexane (1:3, vol/vol) to provide 24 g of desired coupler (M-2).

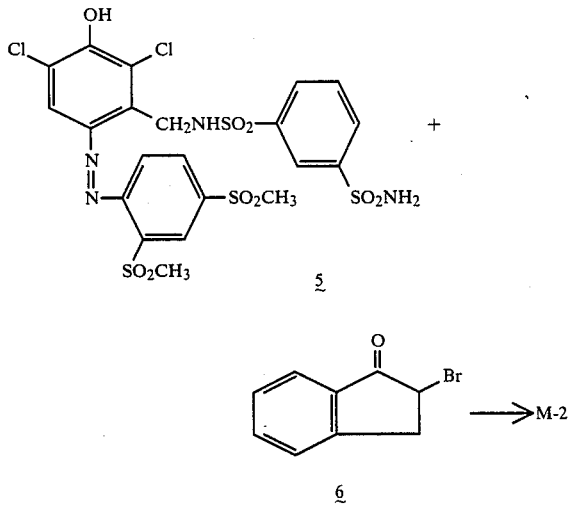

SYNTHESIS EXAMPLE 4

Synthesis of Coupler (Y-17)

In 100 ml of toluene were suspended 20 g (0.038 mole) of compound 7 shown below and 21 g (0.038 mole) of compound 8 shown below and after adding thereto 5.4 g (0.038 mole) of anhydrous potassium carbonate, the mixture was refluxed for 5 hours. After distilling off the solvent from the reaction mixture at reduced pressure, the residue thus formed was dissolved in ethyl acetate and the solution was washed repeatedly with an aqueous 2% hydrochloric acid solution and then washed with water. Thereafter, the organic layer thus formed was collected and concentrated under reduced pressure to provide 34 g of a solid material, which was recrystallized from ethyl acetate and then hexane and thereafter from a mixture of these solvents (1:3, vol/vol) to provide 14 g of desired coupler (Y-17).

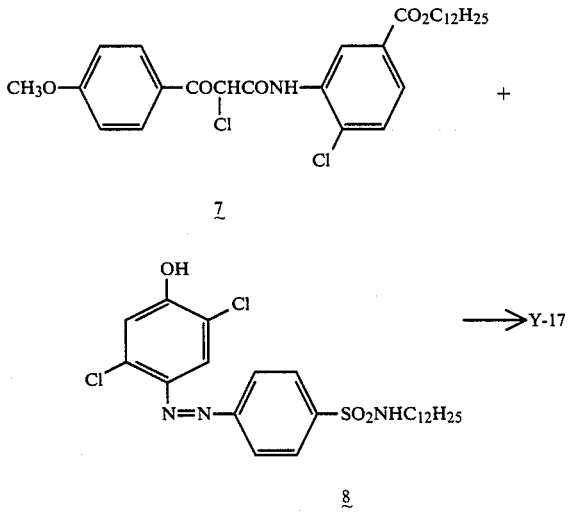

SYNTHESIS EXAMPLE 5

Synthesis of Coupler (C-1)

(i) Synthesis of Compound 11

In 300 ml of dimethylformamide (DMF) were dissolved 33 g (0.05 mole) of compound 9 shown below and 22 g (0.05 mole) of compound 10 shown below and the solution was stirred in a stream of nitrogen. To the solution was gradually dropwise added 50 ml of aqueous solution of 12 g (0.3 mole) of NaOH. After the mixture was reacted at temperature of 80° C. for 5 hours, the reaction solution was poured into ice containing hydrochloric acid to form crude crystals. The crystals were collected by filtration, recrystallized from ethyl alcohol and dried to provide 30 g of yellow crystals of the desired compound 11.

(ii) Synthesis of Compound 12

In a mixture solvent of 300 ml of isopropyl alcohol (IPA), 30 ml of acetic acid (AcOH) and 50 ml of water were added 16.8 g (0.3 mole) of reduced iron and 4 g of $NH_4Cl$, and the solution was stirred with heating for 30 minutes. To the refluxed mixture was gradually added 300 ml of the dimethyl acetamide (DMAc)/IPA solution (3:1, vol/vol) of 30 g (0.03 mole) of compound 11. After completion of addition, the mixture was continued to be refluxed for 30 minutes and then the insoluble material was filtered off with heating. To the filtrate was added water and the mixture was cooled to form crude crystals. The crystals were washed with water and ethanol and dried to provide 26 g of yellow crystals. The crystals, which were not purified, were suspended into 300 ml of chloroform and the suspension was cooled with ice. To the ice-cooled suspension was gradually dropwise added 200 ml of chloroform solution of 6.9 g (0.05 mole) of benzoic acid at temperature of 0° C. After completion of addition, the reaction solution was allowed to stand overnight at temperature of 0° C. and the reaction solution was washed with a cooled aqueous sodium carbonate solution to be neutralized. After washed with water, chloroform layer was dried and chloroform was distilled off to form greenish brown solid. The solid was washed with methanol to provide 25.4 g of the desired compound 12.

(iii) Synthesis of Coupler (C-1)

To 200 ml of acetic acid was dissolved 4.3 g (0.02 mole) of compound 13 with warming and the solution was cooled to room temperature. To the cooled solution was added 20 g (0.02 mole) of compound 12, and the mixture was stirred for 2 hours and then allowed to stand overnight to form crude crystals. The crystals which were collected by filtration were washed with acetic acid and continuously washed with water and recrystallized from 95% of ethanol to provide 16 g of crystal of the desired coupler (C-1).

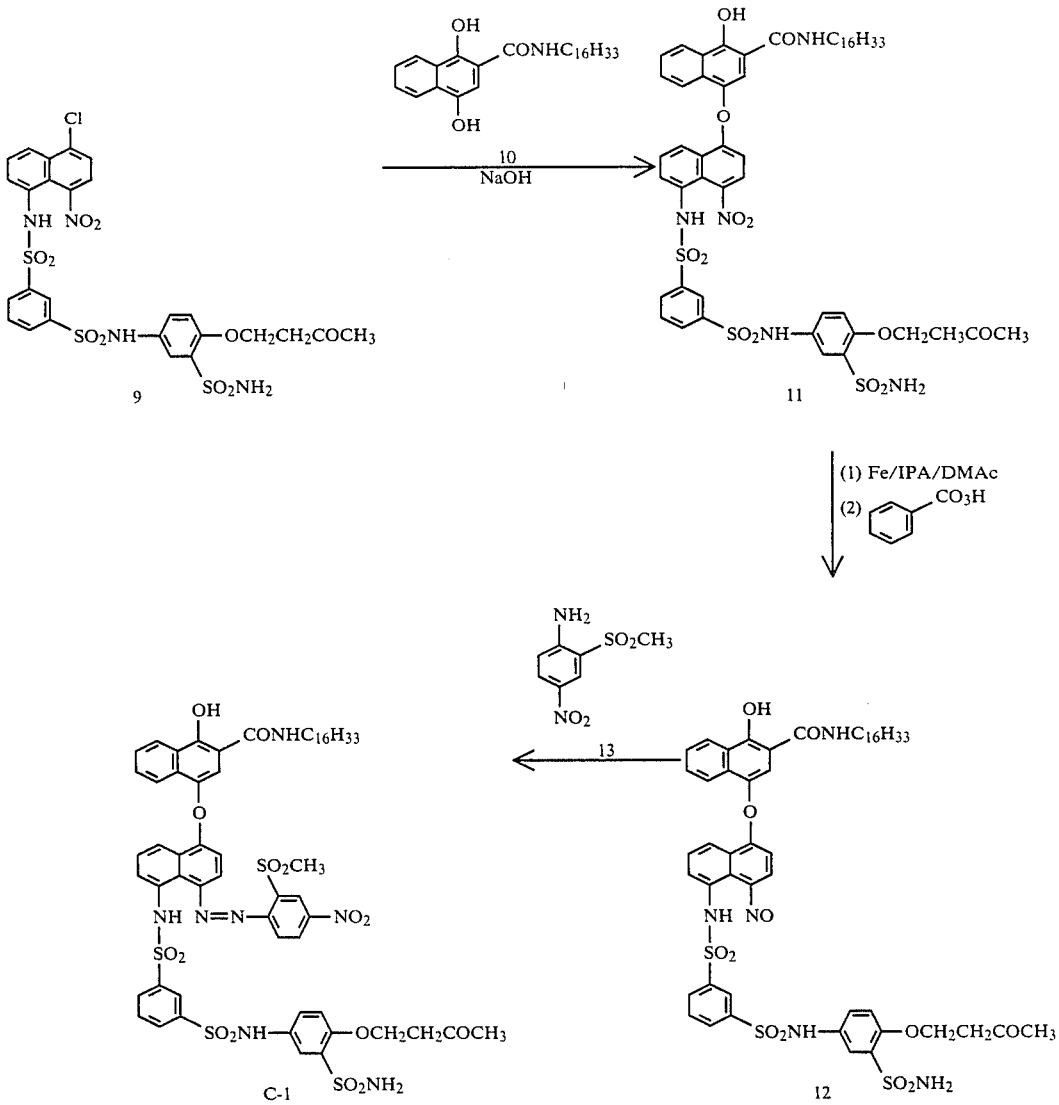

Then, as the compound capable of fixing the hue of compound A formed by coupling with the coupler of this invention shown by the general formula (I) to a long wave length and/or capable of immobilizing said compound A in a photographic layer (hereinafter, such a compound is simply referred to as a dye-fixing compound), there are compounds represented by the following general formula (XVI) or (XVII).

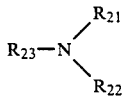

(XVI)

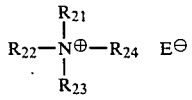

(XVII)

wherein, $R_{21}$ represents an aliphatic group, an aryl group, or a heterocyclic group; $R_{22}$, $R_{23}$ and $R_{24}$ each represents a hydrogen atom, an alkyl group or an aryl group; $R_{22}$, $R_{23}$ and $R_{24}$ may be condensed with each other to form a closed ring or each of them may be condensed with $R_{21}$ to form a closed ring.

Also, the total sum of the carbon atoms contained in the compound shown in the general formula (XVI) or (XVII) is at least 10.

When $R_{21}$ represents an aliphatic group, the aliphatic group is a straight chain or branched alkyl group having 1 to 32 carbon atoms, an alkyl group, an aralkyl group, an alkenyl group, a cycloalkyl group, a cycloalkenyl group, or an alkinyl group. These groups may be substituted with a halogen atom (e.g., a chlorine atom, a fluorine atom, etc.), an aryl group (e.g., a phenyl group, an $\alpha$- or $\beta$-naphthyl group, a 2,4-dichlorophenyl group, a 3-pentadecylphenyl group, a 2,4-di-t-amylphenyl group, etc.), a heterocyclic group (e.g., a 2-pyridyl group, a 2-benzothiazolyl group, a 2-furyl group, an N-piperidyl group, an N-phthalimido group, etc.), a cyano group, an alkoxy group (e.g., a methoxy group, a butoxy group, a 2-ethylhexyloxy group, a 2-methanesulfonylethoxy group, a 3-phenoxypropoxy group, a hexadecyloxy group, etc.), aryloxy group (e.g., a phenoxy group, a 4-chlorophenoxy group, a 2,4-di-tert-butylphenoxy group, a 3-methanesulfonamidophenoxy group, a 4-cyanophenoxy group, a 2-naphthoxy group, etc.), an acylamino group (e.g., an acetoamido group, a benzamido group, a 2,4-di-tertamylphenoxyacetamido group, a 2-(2-chlorophenoxy)tetradecanamido group, 3-[2-(2,4-di-tert-hexyl)butylamido]benzamido group, etc.), an imido group (e.g., a succinimido group, a phthalimido group, an N-hydantoinyl group, etc.), an anilino group (e.g., a phenylamino group, a 2-chloroanilino group, an N-methylanilino group, a 2-chloro-5-tetradecanamidoanilino group, a 4-methoxyanilino group, etc.), an alkylamino group (e.g., a methylamino group, an N,N-diethylamino group, an N-(2-ethoxyethoxy)amino group, etc.), a heterocyclic amino group (e.g., a 2-pyridylamino group, a 2-imidazolylamino group, a 2-pyridylamino group, etc.), a ureido group (e.g., a methylureido group, an N,N-dipropylureido group, a phenylureido group, a 4-chlorophenylureido group, a 4-propanesulfonylphenylureido group, etc.), a sulfamoylamino group (e.g., an N,N-dimethylsulfamoylamino group, an N-methyl-N-phenylsulfamoylamino group, an N,N-diisopropylsulfamoylamino group, etc.), an alkylthio group (e.g., a butylthio group, a dodecylthio group, a 3-phenoxypropylthio group, a cyclopentylthio group, a benzylthio group, etc.), an arylthio group (e.g., a phenylthio group, a 2-methylphenylthio group, a 4-dodecylphenylthio group, a 2-butyoxy-5-tert-octylphenylthio group, a 4-dodecyloxyphenylthio group, etc.), a heterocyclic thio group (e.g., 2-benzoxazorylthio group, a 1-ethyltetrazole-5-thio group,

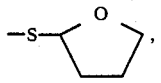

etc.), an alkoxycarbonylamino group (e.g., a methoxycarbonylamino group, a butoxycarbonylamino group, etc.), an aryloxycarbonylamino group (e.g., a phenoxycarbonylamino group, etc.), a sulfonamido group (e.g., a methanesulfonamido group, a benzenesulfonamido group, a dodecanesulfonamido group, a 4-dodecyloxybenzenesulfonamido group, etc.), a carbamoyl group (e.g., an N-methylcarbamoyl group, an N,N-dibutylcarbamoyl group, an N-phenylcarbamoyl group, an N-methyl-N-phenylcarbamoyl group, etc.), a sulfamoyl group (e.g., an N-butylsulfamoyl group, an N-phenylsulfamoyl group, an N,N-dipropylsulfamoyl group, an N-methyl-N-phenylsulfamoyl group, etc.), a sulfonyl group (e.g., a methanesulfonyl group, a dodecanesulfonyl group, a benzenesulfonyl group, a 4-toluenesulfonyl group, etc.), a sulfinyl group (e.g., a methanesulfinyl group, a benzenesulfinyl group, etc.), an acyl group (e.g., an acetyl group, a propanoyl group, a dodecanoyl group, a benzoyl group, a pivaloyl group, a 4-methoxybenzoyl group, etc.), an alkoxycarbonyl group (e.g., a methoxycarbonyl group, a tetradecyloxycarbonyl group, etc.), an aryloxycarbonyl group (e.g., a phenoxycarbonyl group, etc.), a phosphonyl group (e.g., a methoxyphosphonyl group, a butylphosphonyl group, a phenylphosphonyl group, etc.), an imino group (e.g., a propylideneimino group, etc.), a cyanothio group, an acyloxy group (e.g., an acetoxy group, an octanoyloxy group, a benzoyloxy group, etc.), a carbamoyloxy group (e.g., an N-acetylaminoxy group, an N-benzoylaminoxy group, etc.), a silyloxy group (e.g., a trimethylsilyloxy group, a dibutylmethylsilyloxy group, etc.), a sulfonyl group (e.g., a methanesulfonyloxy group, a benzenesulfonyloxy group, etc.), a heterocyclic oxy group (e.g., a 1-phenyltetrazole-5-oxy group, a 2-tetrahydropyranyl-oxy group, etc.), a hydroxy group, a nitro group, etc.

When $R_{21}$ represents an aryl group, the aryl group has 6 to 38 carbon atoms and are a phenyl group, an $\alpha$- or $\beta$-naphthyl group, or an aryl group substituted with the groups illustrated as the substituent of the aliphatic group shown by $R_{21}$ described above, a straight chain or branched alkyl group, an aralkyl group, an alkenyl group, a cycloalkyl group, a cycloalkenyl group, or an alkinyl group.

When $R_{21}$ represents a heterocyclic group, the heterocyclic ring may be a saturated or unsaturated one, contains at least one nitrogen atom, oxygen atom or sulfur atom as the hetero atom(s), an atom bonded to the nitrogen atom of the compound shown by the general formula (XIV) or (XVII) above is a nitrogen atom or a carbon atom, and may be substituted with the groups illustrated as the substituent of the aliphatic group shown by $R_{21}$ described above, a straight chain or branched alkyl group, an aralkyl group, an alkenyl group, a cycloalkyl group, a cycloalkenyl group, an alkinyl group, etc.

The aliphatic group and the aryl group shown by $R_{22}$, $R_{23}$ and $R_{24}$ have the same meaning as the aliphatic group and the aryl group described in detail as $R_{21}$ group, respectively.

$E^{\ominus}$ in the general formula (XVII) above represents an anion, such as halogen ion (e.g., chloride ion, bromide ion, iodide ion, etc.), sulfuric acid ester ion (e.g., methylsulfuric acid ion, ethylsulfuric acid ion, etc.), alkyl or arylsulfonic acid ion (e.g., methanesulfonic acid ion, ethanesulfonic acid ion, p-toluenesulfonic acid ions, etc.), acetic acid ion, sulfuric acid ion, etc.

Among these ions, chloride ion, alkylsulfuric acid ion, alkylsulfuric acid ion, and arylsulfuric acid ion are particularly preferred.

Practical examples of the compounds shown by the general formulae (XVI) and (XVII) are shown below but the invention is not restricted to these compounds.

$(C_{18}H_{37})_3N$ E-1

$C_{12}H_{25}N(CH_2CH_2OH)_2$ E-2

$(C_8H_{17})_3N$ E-3

E-4

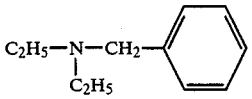

E-5

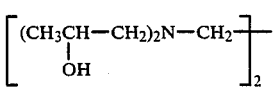

E-6

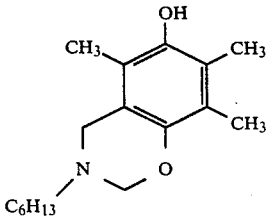

-continued
E-7
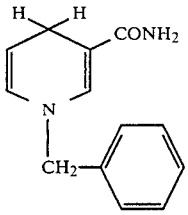
E-8
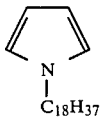
E-9
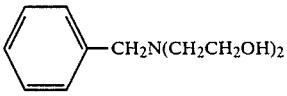
E-10
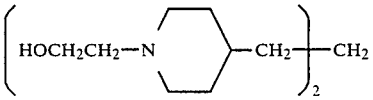
E-11
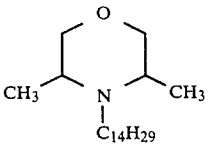
E-12
$(C_{18}H_{37})_2NH$
E-13
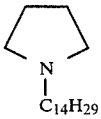
E-14
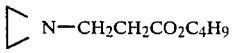
E-15
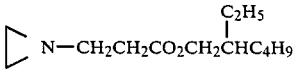
E-16
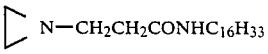
E-17
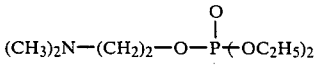
E-18
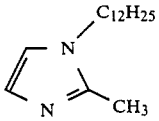
E-19
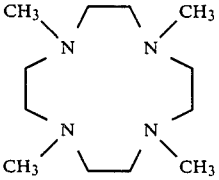
-continued
E-20
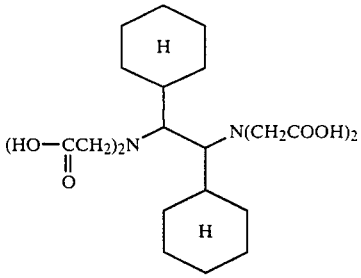
E-21
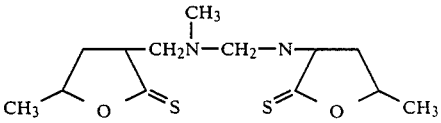
E-22
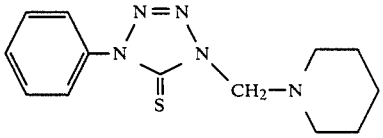
E-23
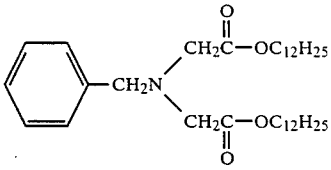
E-24
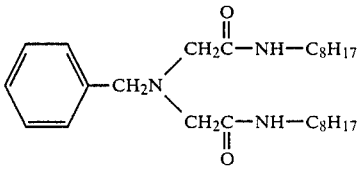
E-25
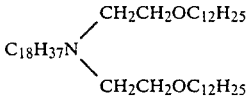
E-26
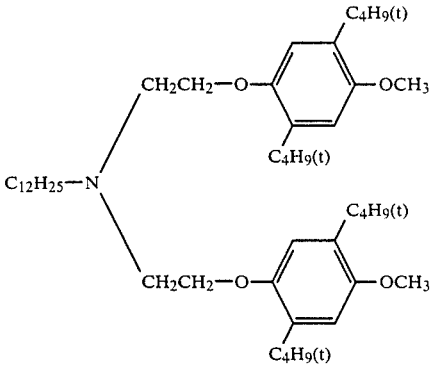
E-27
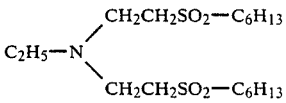
E-28
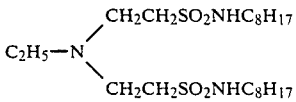

-continued
E-29
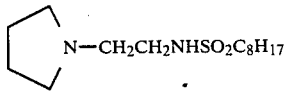
E-30
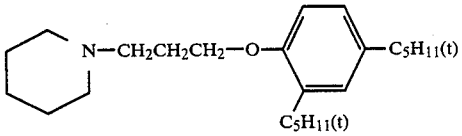
E-31
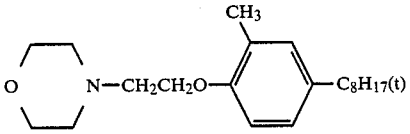
E-32
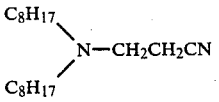
E-33
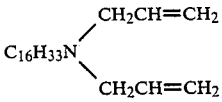
E-34
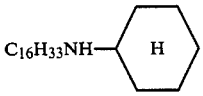
E-35
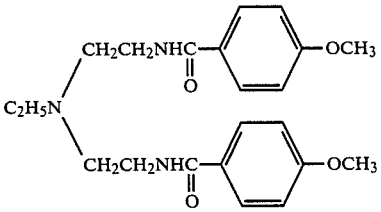
E-36
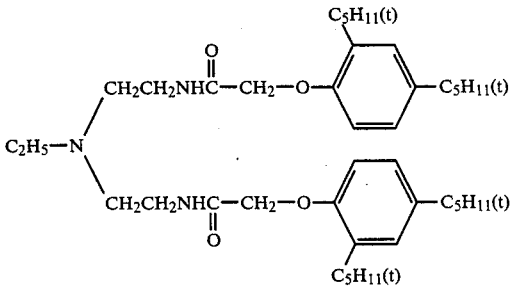
E-37
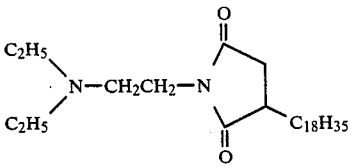
E-38
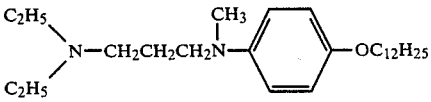
-continued
E-39
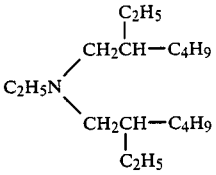
E-40
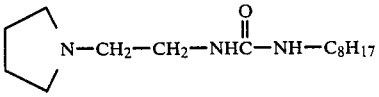
E-41
$N(CH_2CH_2S-C_{10}H_{21})_3$
E-42
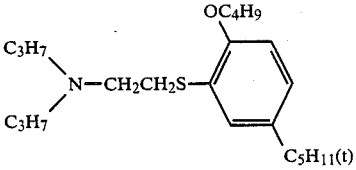
E-43
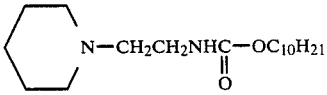
E-44
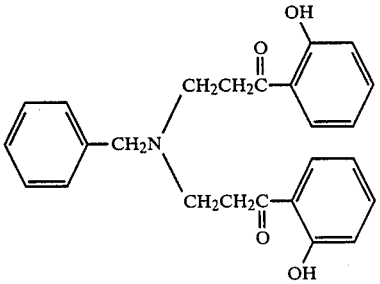
E-45
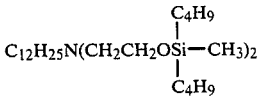
E-46
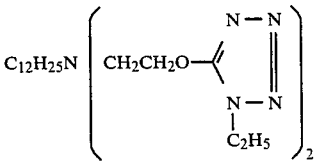
E-47
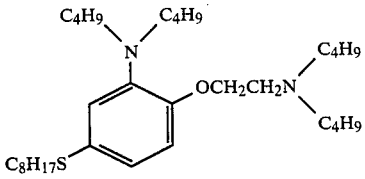
E-48
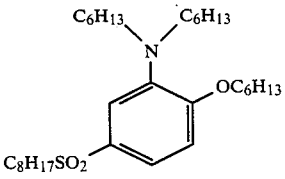

-continued
E-49
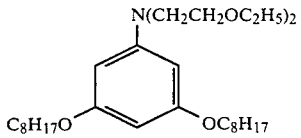
E-50
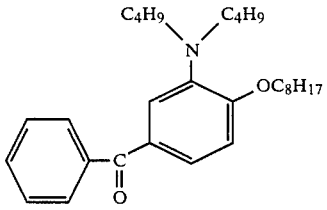
E-51
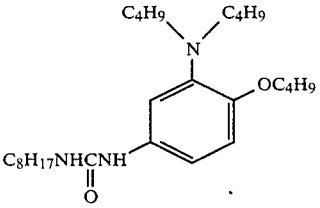
E-52
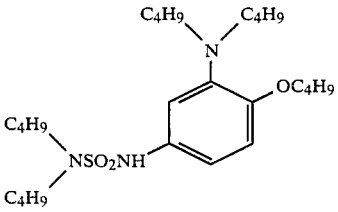
E-53
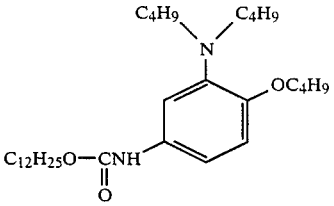
E-54
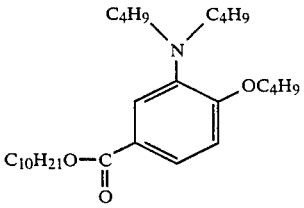
E-55
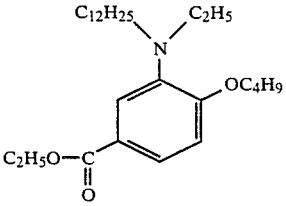
-continued
E-56
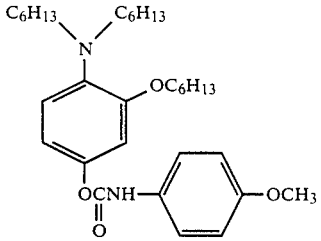
E-57
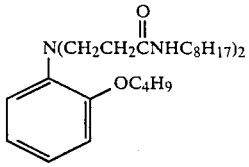
E-58
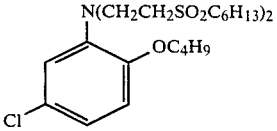
E-59
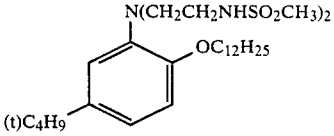
E-60
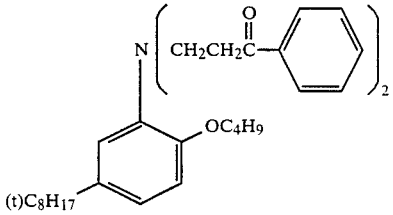
E-61
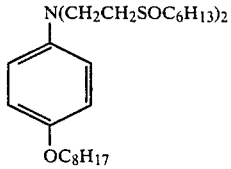
E-62
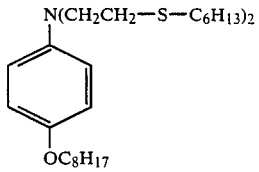
E-63
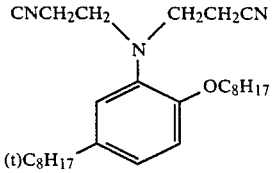

-continued

E-64

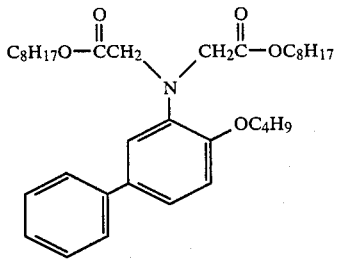

E-65

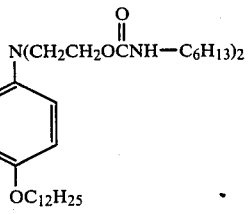

E-66

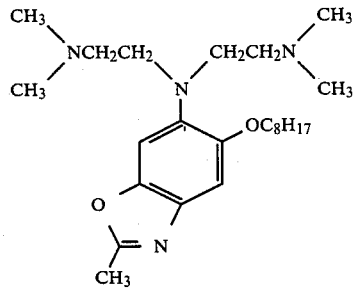

E-67

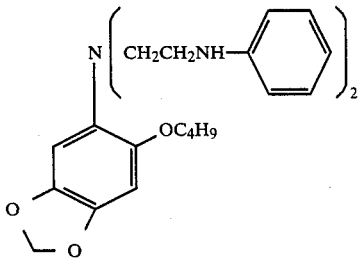

E-68

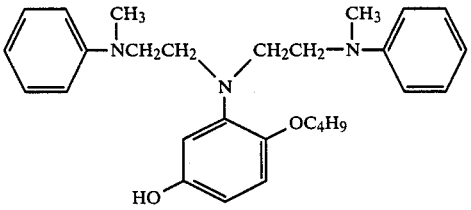

E-69

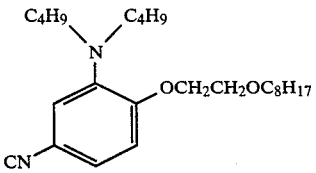

E-70

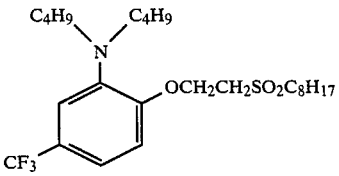

-continued

E-71

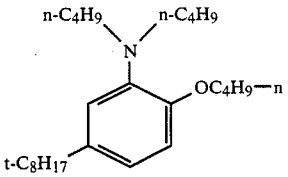

E-72

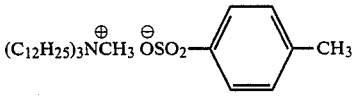

E-73

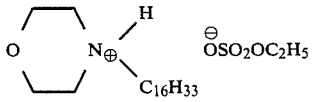

E-74

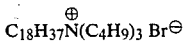

E-75

E-76

E-77

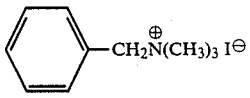

E-78

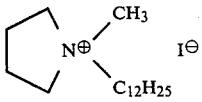

E-79

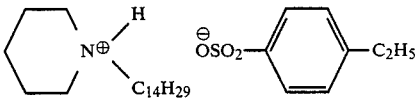

In addition to the above compounds, the inorganic acid (e.g., hydrochloric acid, sulfuric acid, etc.) salts or organic acid (e.g., p-toluenesulfonic acid, methanesulfonic acid, etc.) salts of the compounds corresponding to E-1 to E-71 are also preferably used in this invention.

The above-described compounds represented by the general formulae (XVI) and (XVII) can be prepared according to the methods described, for example, in G. Hilgetag, A. Martini, *Preparative Organic Chemistry*, page 448 (published by John Wiley and Sons, Inc., 1972), S. Patai, *The Chemistry of the Amino Group* (published by John Wiley and Sons, Inc., 1968), etc.

Also, it is preferred that the compound shown by the general formula (XVI) or (XVII) described above is incorporated in a same photographic layer containing the coupler of this invention or the adjacent layer to the coupler-containing layer but as the case may be, the compound may be exist in other layer(s).

The addition amount of the compound is 0.01 to 100 moles, preferably 0.1 to 10 moles per mole of the coupler of this invention.

Also, as the compound (dye-fixing compound) capable of fixing the hue of above-described compound A to a long wave length and/or capable of immobilizing said compound A in the photographic layer, a polymer compound having the moiety structure of the aforesaid general formula (XVI) or (XVII) in the molecule is preferred. Such a polymer compound is a compound called "polymer mordant" in the field of the art and there are a polymer containing primary amino group, secondary amino group or tertiary amino group and a polymer containing a nitrogen-containing heterocyclic moiety and a polymer containing a quaternary cationic group derived from the group or moiety in the above described polymers. The molecular weight of the polymer compound is about 5,000 to 200,000, in particular, 10,000 to 50,000.

Examples of the polymer compounds are the vinylpyridine polymers and vinylpyridinium cation polymers disclosed in U.S. Pat. Nos. 2,548,564, 2,484,430, 3,148,061, 3,756,814, etc.; the imidazole series polymers described in Japanese Patent Application (OPI) Nos. 48210/70, 129346/80, U.S. Pat. Nos. 4,282,305, 4,273,853, 4,193,796, 4,228,257, 4,229,515, etc.; the polymer mordants capable of crosslinking with gelatin disclosed in U.S. Pat. Nos. 3,652,694, 3,859,096, 4,128,538, British Pat. No. 1,277,453, etc.; the aqueous sol-type mordants described in U.S. Pat. Nos. 3,958,995, 2,721,852, 2,798,063, Japanese Patent Application (OPI) Nos. 115228/79, 145529/79, 126027/79, etc.; the water-insoluble mordants disclosed in U.S. Pat. No. 3,898,088; the reactive mordants capable of causing covalent-bonding with dyes disclosed in U.S. Pat. No. 4,168,976 (corresponding to Japanese Patent Application (OPI) No. 137333/79), etc.; and the mordants disclosed in U.S. Pat. Nos. 3,709,690, 3,788,885, 3,642,482, 3,488,706, 3,557,066, 3,271,147, 3,271,148, Japanese Patent Application (OPI) Nos. 71332/75, 30328/78, 155528/77, 125/78, 1024/78, etc.

The mordants which are hard to transfer from the mordant-containing layer to other layer(s) are preferred.

In the above-described polymer mordants, the polymers having the recuring unit represented by the following general formula (XVIII), (XIX), (XX), or (XXI) are preferably used in this invention.

[XVIII]

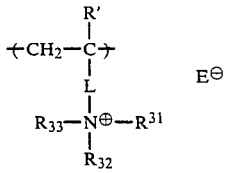

[XIX]

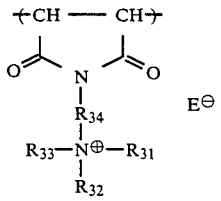

[XX]

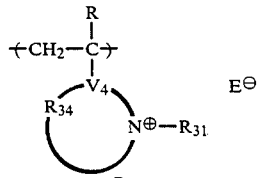

[XXI]

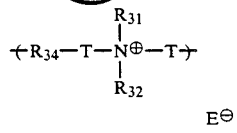

-continued

In the above formulae, R′ represents a group selected from the groups described above as R group in the general formulae (XIV) and (XV) and is preferably a hydrogen atom or a methyl group from a point of polymerization reactivity.

$R_{31}$, $R_{32}$ and $R_{33}$, which may be the same or different, each represents an alkyl group having 1 to about 20 carbon atoms or an aralkyl group having 7 to about 20 carbon atoms and $R_{31}$ and $R_{32}$ may combine with each other to form a cyclic structure with N.

The alkyl group and the aralkyl group shown by $R_{31}$, $R_{32}$ or $R_{33}$ include substituted alkyl groups and substituted aralkyl groups, respectively.

Examples of the alkyl group are an unsubstituted alkyl group such as a methyl group, an ethyl group, a propyl group, an isopropyl group, a t-butyl group, a hexyl group, a cyclohexyl group, a 2-ethylhexyl group, a dodecyl group, etc.; a substituted alkyl group such as an alkoxyalkyl group (e.g., a methoxymethyl group, a methoxybutyl group, an ethoxyethyl group, a butoxyethyl group, a vinylethyl group, etc.), a cyanoalkyl group (e.g., a 2-cyanoethyl group, a 3-cyanopropyl group, etc.), a halogenated alkyl group (e.g., a 2-fluoroethyl group, a 2-chloroethyl group, a perfluoroproply group, etc.), an alkoxycarbonylakyl group (e.g., an ethoxycarbonylmethyl group, etc.), an allyl group, a 2-butenyl group, a propagyl group, a hydroxyalkyl group, etc.

Examples of the aralkyl group shown by aforesaid $R_{31}$, $R_{32}$, or $R_{33}$ are an unsubstituted aralkyl group such as a benzyl group, a phenethyl group, a diphenyl group, a naphthylmethyl group, etc., and a substituted aralkyl group such as an alkylaralkyl group (e.g., a 4-methylbenzyl group, a 2,5-dimethylbenzyl group, a 4-isopropylbenzyl group, a 4-octylbenzyl group, etc.), an alkoxyaralkyl group (e.g., a 4-methoxybenzyl group, a 4-pentafluoropropenyloxybenzyl group, a 4-ethoxybenzyl group, etc.), a cyanoaralkyl group (e.g., a 4-cyanobenzyl group, a 4-(4-cyanophenyl)benzyl group, etc.), a halogenated aralkyl group (e.g., a 4-chlorobenzyl group, a 3-chlorobenzyl group, a 4-bromobenzyl group, a 4-(4-chlorophenyl)benzyl group, etc.), etc.

It is preferred that the carbon atoms of the alkyl group are 1 to 12 and those of the aralkyl group are 7 to 14.

Examples of the cyclic structures which are formed by the connection of $R_{31}$ and $R_{32}$ with N are as follows.

(XXII)

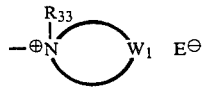

wherein, $W_1$ represents an atomic group necessary for forming an aliphatic heterocyclic ring with N.

(XXIII)

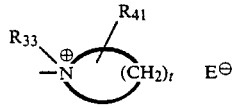

wherein, $R_{41}$ represents a hydrogen atom or the groups described above as $R_{33}$ group and t is an integer of 2 to 12.

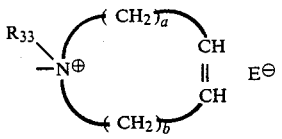

(XXIV)

wherein, a+b is an integer of 2 to 7.

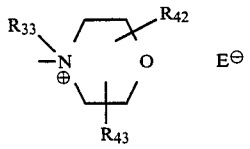

(XXV)

wherein, $R_{42}$ and $R_{43}$ each represents a hydrogen atom or a lower alkyl group having 1 to 6 carbon atoms.

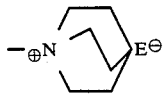

(XXVI)

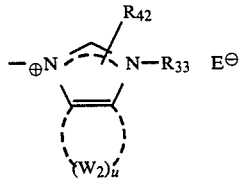

(XXVII)

wherein, $W_2$ represents an atomic group necessary of forming a benzene ring and u represents 0 or 1.

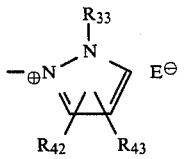

(XXVIII)

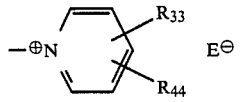

(XXIX)

wherein, $R_{44}$ represents a hydrogen atom,

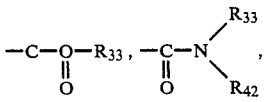

or the groups described above as $R_{33}$ group. In the case of two $R_{33}$'s, they may be the same or different.

In these ring structures, those shown by the general formulae (XXIII) or (XXVII) are preferred.

$R_{34}$, L and T in the aforesaid general formulae (XVIII) to (XXI) represent a divalent atom having 1 to about 12 carbon atoms.

$R_{34}$ in the above-described general formulae (XIX) to (XXI) represents an alkylene group (e.g., a methylene group, an ethylene group, a trimethylene group, a tetramethylene group, etc.), an arylene group (e.g., a phenylene group, etc.), or an aralkylene group (e.g.,

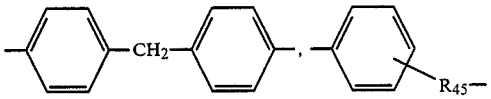

(wherein, $R_{45}$ represents an alkylene group having 1 to about 6 carbon atoms).

L in the general formula (XVIII) is preferably

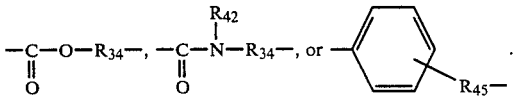

T in the general formula (XXI) is preferably

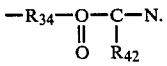

$V_4$ in the general formula (XX) represents a carbon atom or a nitrogen atom.

$E^{63}$ in the general formulae (XVIII) to (XXIX) shown above represents an anion selected from the anions explained in regard to the general formulae (XVI) and (XVII).

The polymer mordant having the partial structure (unit) shown by the above-described general formula (XVIII), (XIX) or (XX) may have two or more these partial structures or may have one or more monomer unit derived from an ethylenically unsaturated monomer. It is preferred that the content of the above-described mordant unit in the polymer mordant is 20 to 80 mole %, preferably 30 to 70 mole %. It is preferred that the proportion of the ethylenically unsaturated monomer is 20 to 60 mole %.

Examples of the ethylenically unsaturated monomer are olefins (e.g., ethylene, propylene, 1-butene, vinyl chloride, vinylidene chloride, isobutene, vinyl bromide, etc.), dienes (e.g., butadine, isoprene, chloroprene, etc.), ethylenically unsaturated esters of fatty acid or aromatic carboxylic acids (e.g., vinyl acetate, allyl acetate, vinyl propionate, vinyl butrate, vinyl benzoate, etc.), esters of ethylenically unsaturated acids (e.g., methyl methacrylate, butyl methacrylate, tert-butyl methacrylate, cyclohexyl methacrylate, benzyl methacrylate, phenyl methacrylate, octyl methacrylate, amyl acrylate, 2-ethylhexyl acrylate, benzyl acrylate, maleic acid butyl ester, fumaric acid diethyl ester, ethyl crotonate, methylenemalonic acid dibutyl ester, etc.), styrenes (e.g., styrene, α-methylstyrene, vinyltoluene, chloromethylstyrene, chlorostyrene, dichlorostyrene, bromostyrene, divinylbenzene, etc.), unsaturated nitriles (e.g., acrylonitrile, methacrylonitrile, 3-cyano-1-propene, crotonitrile, etc.), trivinylhexanone, N-vinyl heterocyclic compounds (e.g., N-vinylimidazole, N-vinylpyrrole, N-vinylpyrazole, N-vinylpyridine, etc.), etc.

It is preferred that the polymer mordant for use in this invention is added to a same photographic layer containing the coupler for use in this invention or the adjacent layer to the photographic layer but the polymer mordant may be added to other layer(s).

The addition amount of the polymer mordant is 0.01 to 100 moles, preferably 0.1 to 10 moles per mole of the coupler of this invention in a mole number of the recuring unit of the dye-fixing group.

Then, practical examples of the polymer mordant for use in this invention are shown below but the invention is not limited to these compounds (wherein, the numeral in the parenthesis is a copolymer mole ratio).

P-1

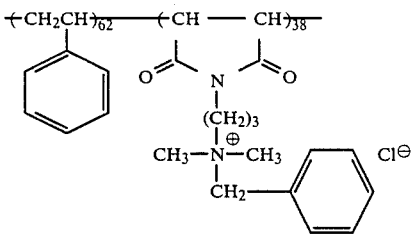

P-2

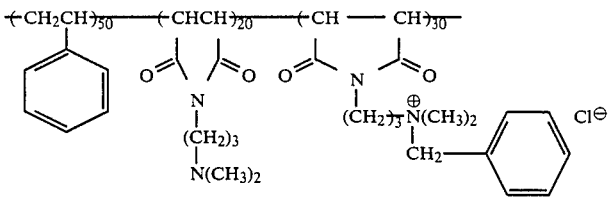

P-3

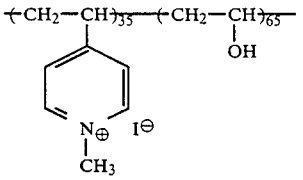

P-4

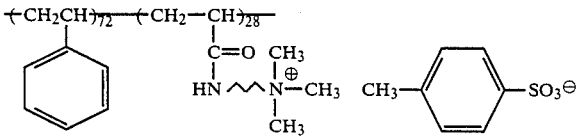

P-5

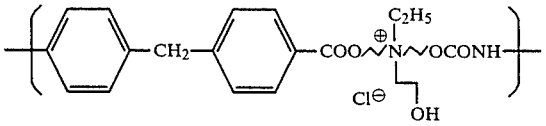

P-6

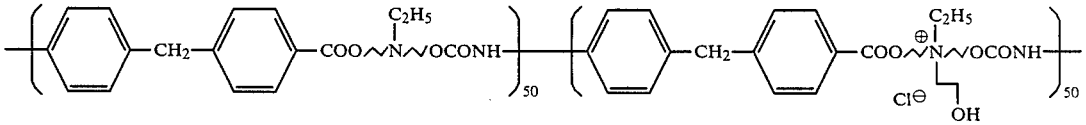

P-7

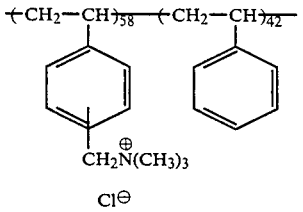

P-8

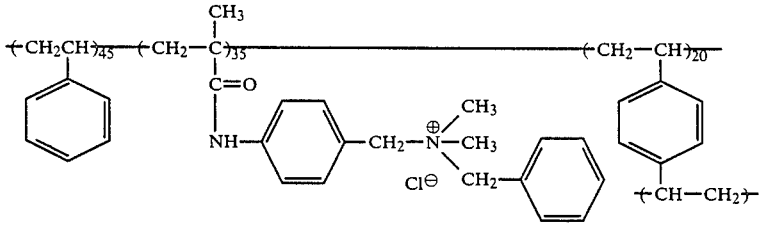

-continued
P-9
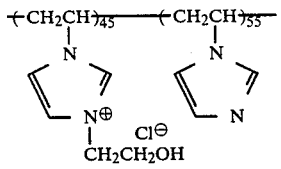
P-10
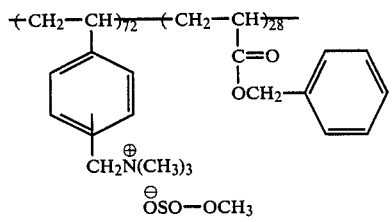
P-11
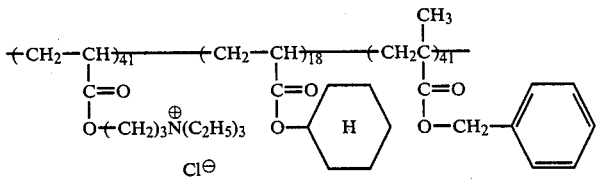
P-12
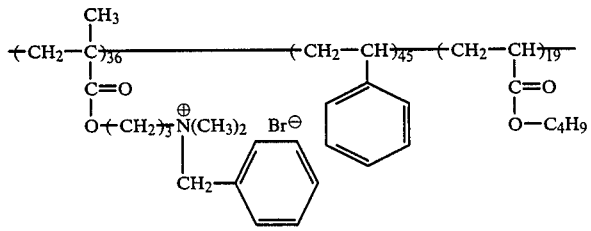
P-13
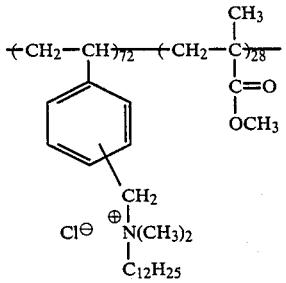
P-14
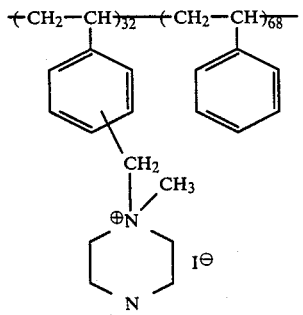

-continued
P-15
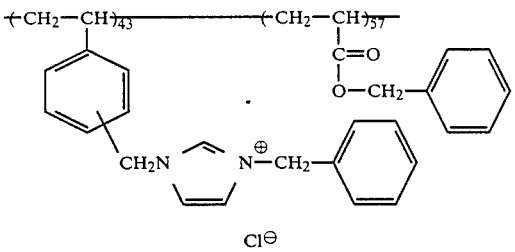
P-16
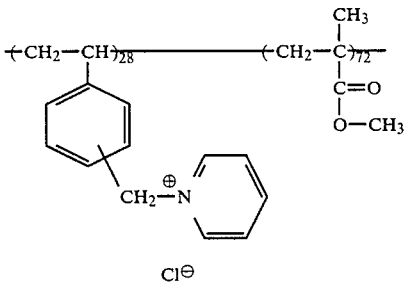
P-17
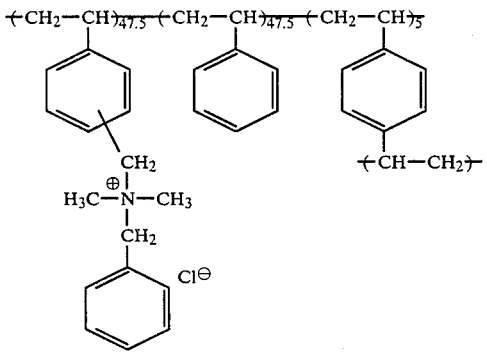
P-18
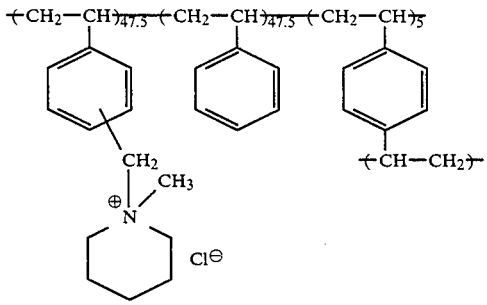
P-19
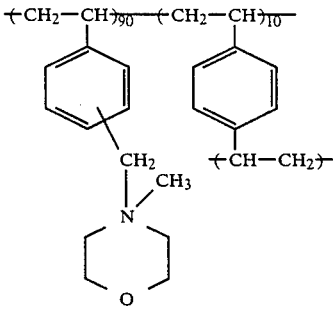

-continued

P-20

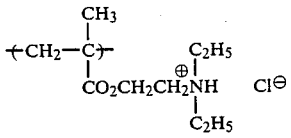

P-21

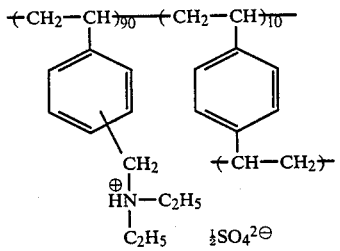

P-22

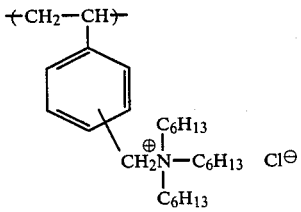

P-23

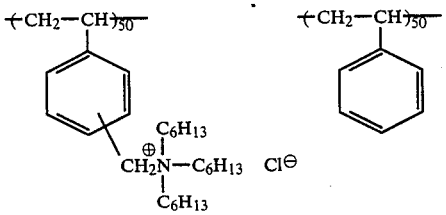

The silver halide color photographic material of this invention may be a monochromatic photographic light-sensitive material having one light-sensitive silver halide emulsion layer on a support or may be a multilayer color photographic light-sensitive material having at least two silver halide emulsion layers of different spectral sensitivities on a support.

Also, this invention can be applied to a photographic light-sensitive material utilizing developed silver as well as the dye formed from the coupler of this invention as images.

A multilayer color photographic material usually has a red-sensitive emulsion layer, a green-sensitive emulsion layer and a blue-sensitive emulsion layer on a support. The order of these emulsion layers may be optionally selected according to the end purpose. It is usual that the red-sensitive emulsion layer contains a cyan-forming coupler, the green-sensitive emulsion layer contains a magenta-forming coupler, and the blue-sensitive emulsion layer contains a yellow-forming coupler but as the case may be, other combinations may be selected.

The photographic emulsion layer or other emulsion layer, or the non-light-sensitive layer of the photographic light-sensitive material of this invention may contain, together with the coupler shown by the above-described general formula (I), other color couplers, that is a compound capable of coloring by an oxidative coupling with an aromatic primary amine developing agent (e.g., a phenylenediamine derivative, an aminophenol derivative, etc.) in color development process.

Also, when the coupler for use in this invention and the above-described color coupler are used in a same colorsensitive emulsion layer or layer group, the proportion of the color coupler is 0.01 mole to 20 moles, preferably 0.01 mole to 10 moles per mole of the coupler of this invention.

For the multilayer silver halide color photographic light-sensitive material of this invention are usually used a yellow-forming coupler, a magenta-forming coupler and a cyan-forming coupler and in this case, the couplers of this invention can be used for all three kinds of the couplers. Also, a part of the couplers of this invention may be replaced, if necessary, by conventionally known color couplers.

Useful color couplers are a cyan-forming coupler, a magenta-forming coupler and a yellow-forming coupler. Typical examples of these couplers are naphtholic or phenolic compounds, pyrazolone or pyrazoloazole series compounds, and open chain or heterocyclic ketomethylene compounds, respectively. These cyan, magenta and yellow couplers which can be used in this invention are described in *Research Disclosure*, 17643 (December 1978), Paragraph VII-D and ibid, 18717 (November 1979).

It is preferred that the color couplers contained in the photographic light-sensitive materials of this invention are rendered non-diffusible by having a ballast group or by being polymerized.

In the case of a two-equivalent color coupler wherein the coupling active position is substituted by an eliminating group, the coating silver amount can be reduced and a higher sensitivity is obtained as compared with the case of a four-equivalent color coupler wherein the coupling active position is a hydrogen atom. Furthermore, non-coloring couplers, DIR couplers releasing a development inhibitor with a coupling reaction, or couplers releasing a development accelerator with coupling reaction can be also used in this invention.

Typical examples of the yellow coupler which can be used in this invention are acylacetamide series couplers. Practical examples of them are described in U.S. Pat. Nos. 2,407,210, 2,875,057, 3,265,506, etc.

Specific examples of two-equivalent yellow couplers for use in this invention are oxygen atom eliminating type yellow couplers described in U.S. Pat. Nos. 3,408,194, 3,447,928, 3,933,501, 4,022,620, etc., and nitrogen atom eliminating type yellow couplers described in Japanese Patent Publication No. 10739/83, U.S. Pat. Nos. 4,041,752, 4,326,024, *Research Disclosure*, 18053 (April 1979), British Pat. No. 1,425,020, West German Patent Application (OLS) Nos. 2,219,917, 2,261,361, 2,329,587, 2,433,812, etc. In these yellow couplers, α-pivaloylacetanilide series couplers are excellent in fastness of colored dyes, in particular light fastness thereof and, on the other hand, α-benzoylacetanilide series couplers give high coloring density.

As the magenta couplers for use in this invention, there are indazolone series couplers, or cyanoacetyl series couplers, and, preferably 5-pyrazolone series couplers and pyrazoloazole series couplers such as pyrazolotriazoles. As the 5-pyrazolone series couplers, the couplers having an arylamino group or an acylamino group at the 3-position thereof as a substituent is preferred from a view point of the hue and the coloring density of the colored dyes. Typical examples of them are described in U.S. Pat. Nos. 2,311,082, 2,343,703, 2,600,788, 2,908,573, 3,062,653, 3,152,896, 3,936,015, etc. As the eliminable group of the two-equivalent 5-pyrazolone series coupler for use in this invention, the nitrogen atom eliminating type group described in U.S. Pat. No. 4,310,619 and the arylthio group described in U.S. Pat. No. 4,351,897 are particularly preferred. Also, the 5-pyrazolone series couplers having a ballast group described in European Pat. No. 73,636 give high coloring density.

As the pyrazoloazole series couplers, there are pyrazolobenzimidazoles described in U.S. Pat. No. 3,369,879, etc., and, preferably, pyrazolo[5,1-c][1,2,4]triazoles described in U.S. Pat. No. 3,725,067; pyrazolotetrazoles described in *Research Disclosure,* 24220 (June 1984), and pyrazolopyrazoles described in *Research Disclosure,* 24230 (June 1984). In the point of showing less yellow absorption of the colored dye and of high light fastness thereof, the imidazo[1,2-b]pyrazoles described in European Pat. No. 119,741 are preferred and also the pyrazolo[1,5-b][1,2,4]triazoles described in European Pat. No. 119,860 are particularly preferred.

As the cyan couplers for use in this invention, there are naphthol and phenol couplers. Typical examples of them are naphtholic couplers described in U.S. Pat. No. 2,474,293, etc., and preferably, the oxygen atom eliminating type two-equivalent naphthol couplers described in U.S. Pat. Nos. 4,052,212, 4,146,396, 4,228,233, 4,296,200, etc. Also, practical examples of the phenolic couplers are described in U.S. Pat. Nos. 2,369,929, 2,801,171, 2,772,162, 2,895,826, etc. Cyan couplers having high fastness to humidity and temperature are preferably used in this invention and typical examples of them are the phenolic cyan couplers having an alkyl group of 2 or more carbon atoms at the meta-position of the phenol nucleus thereof described in U.S. Pat. No. 3,772,002; the 2,5-diacylamino-substituted phenolic couplers described in U.S. Pat. Nos. 2,772,162, 3,758,308, 4,126,396, 4,334,011, 4,327,173, West German Patent Application (OLS) No. 3,329,729, Japanese Patent Application No. 42671/83 (corresponding to U.S. Pat. No. 4,500,635), etc., and the phenolic couplers having a phenylureido group at the 2-position and an acylamino group at the 5-position described in U.S. Pat. Nos. 3,446,622, 4,333,999, 4,451,559, 4,427,767, etc.

For correcting unnecessary absorptions of the dyes formed from magenta couplers and cyan couplers at a short wave length region, it is preferred to use colored couplers in the color photographic light-sensitive materials for photography. Typical examples of them are the yellow colored magenta couplers described in U.S. Pat. No. 4,163,670, Japanese Patent Publication No. 39413/82 and the magenta colored cyan couplers described in U.S. Pat. Nos. 4,004,929, 4,138,258, British Pat. No. 1,146,368, etc.

In this invention, it is possible to improve the graininess by using a coupler giving a colored dye having a controlled smearing. Practical examples of such magenta couplers are described in U.S. Pat. No. 4,366,237 and British Pat. No. 2,125,570 and also practical examples of such yellow, magenta and cyan couplers are described in European Pat. No. 96,570 and West German Patent Application (OLS) No. 3,234,533.

The dye-forming couplers and the above-described specific couplers may form a dimer or more polymer. Typical examples of the polymerized dye-forming couplers are described in U.S. Pat. Nos. 3,451,820 and 4,080,211. Practical examples of the polymerized magenta couplers are described in British Pat. No. 2,102,173 and U.S. Pat. No. 4,367,282.

These couplers may be a four-equivalent or two-equivalent to silver ion. Also, they may be colored couplers having a color correcting effect or so-called DIR couplers capable of eliminating a development inhibitor with the progress of development.

Also, in place of the DIR couplers, non-coloring DIR coupling compounds which give a colorless coupling reaction product and release a development inhibitor may be used. Also, a compound capable of releasing a development inhibitor with the progress of development may be used in place of the DIR coupler.

The above-described various couplers may be used in a same light-sensitive layer as a combination of the two or more for satisfying the characters required for the color photographic light-sensitive material or a same coupler may be introduced in two or more light-sensitive layers of the light-sensitive material.

For introducing the couplers of this invention and other coupler(s) which can be used together with the couplers of this invention into silver halide emulsion layers, the known method described, for example, in U.S. Pat. No. 2,322,027 may be used. For example, the coupler is dissolved in a high-boiling organic solvent having a boiling point of about 150° C. or more such as a phthalate, etc.) a phosphoric acid ester (e.g., diphenyl phosphate, triphenyl phosphate, tricresyl phosphate, dioctylbutyl phosphate, etc.), a citric acid ester (e.g., tributyl acetylcitrate, etc.), a benzoic acid ester (e.g., octyl benzoate, etc.), an alkylamide (e.g., diethylaurylamide, etc.), a fatty acid ester (e.g., dibutoxyethyl succinate, diethyl azerate, etc.), a trimesic acid ester (e.g., tributyl trimesate, etc.), etc., or a low-boiling organic solvent having a boiling point of about 30° C. to 150° C., such as a lower alkyl acetate (e.g., ethyl acetate, butyl acetate, etc.), ethyl propionate, secondary butyl alcohol, methyl isobutyl keytone, β-ethoxyethyl acetate, methylcellosolve acetate, etc., and then the solution thereof is dispersed in a hydrophilic colloid. In this case, a mixture of the above-described high-boiling organic solvent and the low-boiling organic solvent may be used.

Also, the polymer dispersing method described in Japanese Patent Publication No. 39853/76 and Japanese Patent Application (OPI) No. 59943/76 can be used.

When the coupler has an acid group such as a carboxylic acid group or a sulfonic acid group, the coupler is introduced into a hydrophilic colloid as an alkaine aqueous solution thereof.

As a binder or a protective colloid which can be used for the silver halide emulsion layer(s) and inter-layer(s) of the photographic light-sensitive materials of this invention, gelatin is advantageously used but other hydrophilic colloids can be used solely or together with gelatin. Gelatin for use in this invention may be lime-processed gelatin or acid-processed gelatin. Details of the production method for gelatin are described in Arthur Veis, *The Macromolecular Chemistry of Gelatin* (published by Academic Press, 1964).

For the photographic emulsion layer(s) of the silver halide photographic light-sensitive material of this invention may be used silver bromide, silver iodobromide, silver iodochlorobromide, silver chlorobromide, silver chloride, etc., as a silver halide. A preferred silver halide in this invention is silver iodobromide containing less than 15 mole % silver iodide. Silver iodobromide containing 2 mole % to 12 mole % silver iodide is particularly preferred in this invention.

There is no particular restriction about the mean grain size of the silver halide grain (when the silver halide grain is spherical or near spherical, the grain size is expressed by the grain diameter and when the silver halide grain is a cubic grain, the grain size is expressed by an edge length, which is expressed by a mean value based on the projection area) but it is preferred that the grain size be less than 3 microns.

The grain size distribution of the silver halide grains for use in this invention may be narrow or broad.

The silver halide grain in the photographic emulsions for use in this invention may have a regular crystal form such as a cube or an octahedron or an irregular crystal form such as a spherical form or a tabular form. The silver halide grains may be a composite form of these crystal forms or a mixture of various crystal form grains.

Also, a silver halide emulsion wherein super tabular silver halide grains having a diameter of the grains more than 5 times the thickness thereof occupies more than 50% of the total projection area may be used.

The silver halide grains for use in this invention may have a different phase between the surface layer and the inside thereof. Also, the silver halide grains may be ones forming a latent image mainly on the surface thereof or ones forming a latent image mainly in the inside thereof.

The silver halide photographic emulsion for use in this invention can be prepared by the method described in P. Glafkides, *Chiemie et Physique Photographique*, published by Paul Montel, 1966; V.L. Zelikman et al, *Making and Coating Photographic Emulsion*, published by The Focal Press, 1964, etc. That is, the photographic emulsions may be prepared by an acid process, a neutral process, an ammonia process, etc., and as a system for reacting a soluble silver salt and a soluble halide, a single jet process, a double jet process, or a combination of them can be used.

Also, a so-called reversal mixing process of forming silver halide grains in the presence of excessive silver ions can be used.

As one of the double jet processes, a so-called controlled double jet process wherein the pAg in the liquid phase of forming silver halide is maintained constant can be used.

According to the aforesaid process, a silver halide emulsion wherein the crystal form is regular and the grain size is almost uniform can be obtained.

Two or more kinds of silver halide emulsions which are prepared separately can be used as a mixture of them.

The silver halide grains for use in this invention may be formed or physically ripened in the presence of a cadmium salt, a zinc salt, a lead salt, a thallium salt, an iridium salt or a complex salt thereof, a rhodium salt or a complex salt thereof, an iron salt or a complex salt thereof, etc.

The silver halide emulsions for use in this invention are usually chemically sensitized.

Examples of the methods for the chemical sensitization are described, for example, in F. Fieser, *Die Grundlagender Photographischen Prozesse mit Silberhalogeniden*, published by Adakdemische Verlagsgesellschaft, 1968, pages 675 to 734.

That is, there are a sulfur sensitization method using active gelatin or a sulfur-containing compound capable of reacting with silver (e.g., thiosulfates, thioureas, mercapto compounds, rhodanines, etc.); reduction sensitization method using a reducing material (e.g., stannous salts, amines, hydrazine derivatives, formamidinesulfinic acid, silane compounds, etc.); and a noble metal sensitization method using a noble metal compound (e.g., a gold complex and a complex salt of a metal belonging to group VIII of the periodic table, such as Pt, Ir, Pd, etc.). These methods may be used individually or as a combination of them.

The silver halide photographic emulsions for use in this invention may further contain various compounds for preventing the formation of fog during the production, storage and photographic process of the photographic light-sensitive materials of this invention or fog stabilizing the photographic performance of the light-sensitive materials. For example, there are antifoggants or stabilizers such as azoles, e.g., benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, mercaptotetrazoles (in particular, 1-phenyl-5-mercaptotetrazole, etc.), etc.; mercaptopyrimidines; mercaptotriazines; thioketo compounds such as oxadolinethione, etc.; azaindenes, e.g., triazaindenes, tetraazaindenes (in particular, 4-hydroxy-substituted (1,3,3a,7)tetraazaindenes), pentaazaindenes, etc.; benzenethiosulfonic acid, benzenesulfinic acid, benzenesulfonic acid amide, etc.

The photographic emulsion layers and other hydrophilic colloid layers of the photographic light-sensitive materials of this invention may contain various surface active agents as coating aids or for static prevention, improvement of slidability, improvement of dispersibility, prevention of adhesion, and improvement of photographic characters (e.g., acceleration of development, increase of contrast, sensitization, etc.).

The photographic emulsion layers of the photographic light-sensitive materials of this invention may further contain polyalkylene oxide or the derivatives thereof (e.g., the ethers, esters, amines, etc., thereof), thioether compounds, thiomorpholines, quaternary ammonium salt compounds, urethane derivatives, urea derivatives, imidazole derivatives, 3-pyrazolidones, etc., for the purposes of increasing sensitivity, increasing contrast, or accelerating development.

The photographic light-sensitive materials of this invention may further contain in the photographic emulsion layers and other hydrophilic colloid layers water-insoluble or water sparingly soluble synthetic polymers for the improvement of dimensional stability. Examples of these polymers are homopolymers or copolymers of alkyl (meth)acrylate, alkoxyalkyl (meth)acrylate, glycidyl (meth)acrylate, (meth)acrylamide, a vinyl ester (e.g., vinyl acetate, etc.), acrylonitrile, olefin, styrene, etc., or copolymers of the above-described monomers and other monomers such as acrylic acid, methacrylic acid, $\alpha,\beta$-unsaturated dicarboxylic acid, hydroxyalkyl (meth)acrylate, sulfoalkyl (meth)acrylate, styrenesulfonic acid, etc.

The silver halide photographic emulsions for use in this invention may be spectrally sensitized by methine dyes. Dyes which are used for the purpose include cyanine dyes, merocyanine dyes, complex cyanine dyes, complex merocyanine dyes, holopolar cyanine dyes, hemicyanine dyes, styryl dyes, and hemioxonole dyes. Particularly useful dyes are cyanine dyes, merocyanine dyes and complex merocyanine dyes. To these dyes can be applied any nuclei which are usually utilized for cyanine dyes. Examples of these nuclei are pyrroline nuclei, oxazoline nuclei, thiazoline nuclei, pyrrole nuclei, oxazole nuclei, thiazole nuclei, senenazole nuclei, imidazole nuclei, tetrazole nuclei, pyridine nuclei, etc.; the nucleus formed by fusing alicyclic hydrocarbon rings to the above-described nuclei; and the nuclei formed by fusing aromatic hydrocarbon rings to the above-described nuclei, such as indolenine nuclei, benzindolenine nuclei, indole nuclei, benzoxazole nuclei, naphthoxazole nuclei, benzothiazole nuclei, naphthothiazole nuclei, benzoselenazole nuclei, benzimidazole nuclei, quinoline nuclei, etc. These nuclei may be substituted on carbon atoms.

For the merocyanine dyes or complex merocyanine dyes can be applied 5-membered or 6-membered heterocyclic nuclei such as pyrazolin-5-one nuclei, thiohydantoin nuclei, 2-thiooxazolidine-2,4-dione nuclei, thiazoline-2,4-dione nuclei, rhodanine nuclei, thiobarbituric acid nuclei, etc.

These sensitizing dyes may be used solely or as a combination of them. A combination of sensitizing dyes is frequently used for super sensitization.

The photographic emulsion layers may contain a dye which does not have a spectral sensitizing action by itself and shows super sensitization together with the aforesaid sensitization dye or a material which does not substantially absorb visible light and shows super sensitization together with the aforesaid sensitizing dye. Examples of these compounds are aminostyl compounds substituted by a nitrogen-heterocyclic group (e.g., U.S. Pat. Nos. 2,933,390, 3,635,721, etc.), aromatic organic acid-formaldehyde condensation products (as described, for example, in U.S. Pat. No. 3,743,510), cadmium salts, azaindene compounds, etc.

The photographic light-sensitive materials of this invention may further contain in the photographic emulsion layers and other hydrophilic colloid layers inorganic or organic hardening agents such as, for example, chromium salts (chromium alum, chromium acetate, etc.), aldehydes (e.g., formaldehyde, glyoxal, glutaraldehyde, etc.), N-methylol compounds (e.g.), dimethylolurea, methyloldimethylhydantoin, etc.), dioxane derivatives (e.g., 2,3-dihydroxydioxane, etc.), active vinyl compounds (e.g., 1,3,5-triacryloyl-hexahydro-s-triazine, 1,3-vinylsulfonyl-2-propanol, etc.), active halogen compounds (e.g., 2,4-dichloro-6-hydroxy-s-triazine, etc.), mucohalogenic acids (e.g., mucochloric acid, mucophenoxychloric acid, etc.), etc., individually or as a combination of them.

When the photographic light-sensitive materials of this invention contain dyes or ultraviolet absorbents in the hydrophilic colloid layers thereof, they may be mordanted by a cationic polymer.

The photographic light-sensitive materials of this invention may further contain hydroquinone derivatives, aminophenol derivatives, gallic acid derivatives, ascorbic acid derivatives, etc., as color fogging preventing agents.

The photographic light-sensitive materials of this invention may contain ultraviolet absorbents in the hydropholic colloid layers. Examples of the ultraviolet absorbents are aryl group-substituted benzotriazole compounds as described, for example, in U.S. Pat. No. 3,533,794, 4-thiazolidone compounds as described, for example, in U.S. Pat. Nos. 3,314,794 and 3,352,681, benzophenone compounds as described, for example, in Japanese Patent Application (OPI) No. 2784/71, cinnamic acid ester compounds as described, for example, in U.S. Pat. Nos. 3,705,805 and 3,707,375, butadiene compounds as described, for example, in U.S. Pat. No. 4,045,229, and benzoxazole compounds as described, for example, in U.S. Pat. No. 3,700,455. Ultraviolet absorptive couplers (e.g., $\alpha$-naphtholic cyan dye-forming couplers) and ultraviolet absorptive polymers may be used as the ultraviolet absorbents. These ultraviolet absorbents may be mordanted in specific layers of the light-sensitive materials.

The photographic light-sensitive materials of this invention may further contain in the hydrophilic colloid layers thereof water-soluble dyes as filter dyes or for irradiation prevention and other various purposes. Examples of such water-soluble dyes are oxonol dyes, hemioxonol dyes, styryl dyes, merocyanine dyes, cyanine dyes, and azo dyes. In these dyes, oxonol dyes, hemioxonol dyes and merocyanine dyes are particularly advantageous.

In this invention, known fading preventing agents described below may be also used. The fading preventing agents for use in this invention may be used solely or as a mixture of two or more of them. Examples of the fading preventing agents are hydroquinone derivatives, gallic acid derivatives, p-alkoxyphenols, p-oxyphenol derivatives, bisphenols, etc.

For processing the photographic emulsion layers of the photographic light-sensitive materials of this invention, known processes and processing liquids described, for example, in *Research Disclosure*, No. 176, pages 28 to 30 can be applied. The processing temperature is usually in the range of 18° C. to 50° C. but may be lower than 18° C. or higher than 50° C.

A color developer which is used for processing the light-sensitive material of this invention is generally composed of an alkaline aqueous solution containing a color developing agent, for example, primary aromatic amine developing agents such as phenylenediamines (e.g., 4-amino-N,N-diethylaniline, 3-methyl-4-amino-N,N-diethylaniline, 4-amino-N-ethyl-N-β-hyroxyethylaniline, 3-methyl-4-amino-N-ethyl -N-β-hydroxyethylaniline, 3-methyl-4-amino-N-ethyl-N -β-methanesulfoamidoethylaniline, 4-amino-3-methyl-N-ethyl-N-β-methoxyethylaniline, etc.).

Other developing agents which can be used in this invention are described in F. A. Mason, *Photographic Processing Chemistry*, pages 226 to 229 (published by Focal Press), U.S. Pat. Nos. 2,193,015, 2,592,364, Japanese Patent Application (OPI) No. 64933/73, etc.

The color developer may further contain a pH buffer such as a sulfite, carbonate, borate, or phosphate of an alkali metal or a development retainer or an antifoggant such as a bromide, an iodide, and organic antifoggants. Also, if necessary, the color developer may further contain a water softener, a preservative such as hydroxylamine, etc., an organic solvent such as benzyl alcohol, diethylene glycol, etc., a development accelerator such as polyethylene glycol, a quaternary ammonium salt, an amine, etc., a dye-forming coupler, a completing coupler, a fogging agent such as sodium boron hydride, an auxiliary developing agent such as 1-phenyl-3-pyrazolidone, etc., a tackifier, a polycarboxylic acid series chelating agent, an antioxidant, etc.

The photographic emulsion layers are usually bleached after color development. The bleaching process may be performed simultaneously with or separately from a fixing process. As the bleaching agent, there are compounds of multi-valent metals such as iron (III), cobalt (III), chromium (VI), copper (II), etc., peracids, quinones, nitroso compounds, etc.

Specific examples of the bleaching agent are ferricyanides; dichromates; organic complex salts of iron (III) or cobalt (III); complex salts of aminopolycarboxylic acids (such as ethylenediaminetetraaceteic acid, nitrilotriacetic acid, 1,3-diamino-2-propanoltetraacetic acid, etc., or an organic complex acid such as citric acid, tartaric acid, malic acid, etc.; persulfates, permanganates, nitrosophenol, etc. In the aforesaid materials, potassium ferricyanide, sodium ethylenediamineteteraacetato ferrate and ammonium ethylenediaminetetraacetato are particularly preferred. An ethylenediaminetetraacetic acid iron (III) complex salt can be used for a bleach solution or a mono-bath bleach-fix (or blix) solution.

A fix solution having a conventional composition can be used in this invention. As a fixing agent, thiosulfates, thiocyanates, and organic sulfur compounds which are known to have an effect as a fixing agent can be used. The fix solution may further contain a water-soluble aluminum salt as a hardening agent.

After fix step or blix step, a stabilization step, etc., is generally perfomed but a simple step wherein a wash step only is performed or a stabilization step only is performed without employing a wash step (as disclosed in Japanese Patent Application (OPI) No. 8543/82) may be employed.

Wash water which is used for the wash step may contain, if necessary, known additives such as chelating agents (e.g., inorganic phosphoric acids, aminopolycarboxylic acids, organic phosphoric acids, etc.), sterilizers or antiseptics for preventing the growth of various bacteria or molds, hardening agents (e.g., magnesium salts, aluminum salts, etc.), and surface active agents for preventing drying load and the formation of uneven processing. Also, the compounds described in L. E. West, *Water Quality Criteria, Photographic Science and Engineering*, Vol. 9, No. 6, pp. 344–359 (1965) can be also used for wash water.

Also, the wash step may be performed using, if necessary two or more baths or a multistage counter-current wash step (e.g., 2 to 9 stages) may be employed for saving the amount of wash water.

As a stabilization liquid for the stabilization step, processing solution for stabilizing dye images is used. For example, there are a liquid having a buffer faculty of pH 3 to 6, or a liquid containing an aldehyde (e.g., formalin). If necessary, the stabilization liquid may further contain, if necessary, a brightening agent, a chelating agent, a sterilizer, an antiseptic, a hardening agent, a surface active agent, etc.

Also, the stabilization step may be performed using, if necessary, two or more baths or multistage counter-current stabilization step (e.g., 2 to 9 stages) may be employed for saving the amount of stabilization liquid, and further the washing step may be omitted. The invention will then be illustrated in more detail by the following examples but not to limit in any way. In addition, the compounds used in the examples except that above-described compounds of this invention are shown at the end of the examples.

EXAMPLE 1

For evaluating the effectiveness of the couplers and compounds of this invention, sample 101 was prepared by coating the following layers on a transparent cellulose triacetate film support having a subbing layer.

Sample 101

| | |
|---|---|
| Silver Halide Emulsion Layer: | |
| A layer containing: | |
| Negative-working silver iodobromide emulsion (silver iodide: 4 mole %; mean grain size: 0.6 μm) | 1.44 g/m$^2$ |
| Cyan coupler (Cp-2) | 0.38 g/m$^2$ |
| Sensitizing dye III | $5 \times 10^{-5}$ mole per mole of Ag |
| High boiling organic solvent 0–3 | 0.40 g/m$^2$ |
| Gelatin | 3.7 g/m$^2$ |
| Protective Layer: A layer containing: | |
| Gelatin | 1.3 g/m$^2$ |
| 2,4-Dichloro-6-hyroxy-s-triazin sodium salt | 50 mg/m$^2$ |

Sample 102

Sample 102 was prepared in the same manner as Sample 101 except that cyan coupler Cp-4 was used in place of cyan coupler Cp-2 in Sample 101.

Sample 103

Sample 103 was prepared in the same manner as Sample 101 except that compound E-71 of this invention was dispersed in the silver halide emulsion together with coupler Cp-2 and high-boiling organic solvent 0-3 so that the coating amount of compound E-71 became 0.30 g/m$^2$ (the equimolar amount to Cp-2).

Samples 104 and 105

Samples 104 and 105 were prepared in the same manner as Samples 101 and 103, respectively, except that the equimolar amount of Coupler C-1 of this invention was used in place of coupler Cp-2.

Each of the samples thus prepared was exposed using a red filter (SC-62, made by Fuji Photo Film Co., Ltd.) for sensitometry and subjected to the color development process as described below. Then, the cyan density of the processed sample was measured and the results thus obtained are shown in Table 1 below.

The photographic processing was performed as follows at 28° C.

| | |
|---|---|
| 1. Color development | 3 min. 15 sec. |
| 2. Bleach | 6 min. 30 sec. |
| 3. Wash | 3 min. 15 sec. |
| 4. Fix | 4 min. 20 sec. |
| 5. Wash | 3 min. 15 sec. |
| 6. Stabilization | 1 min. 30 sec. |

The compositions of the processing liquids used for the above-described steps were as follows.

| | |
|---|---|
| Color developer: | |
| Sodium nitrilotriacetate | 1.0 g |
| Sodium sulfite | 4.0 g |
| Sodium carbonate | 30.0 g |
| Potassium bromide | 1.4 g |
| Hydroxylamine sulfate | 2.4 g |
| 4-(N—Ethyl-N—β-hydroxyethylamino)-2-methylaniline sulfate | 4.5 g |
| Water to make | 1.0 liter |
| Bleach liquid: | |
| Ammonium bromide | 160.0 g |
| Aqueous ammonia (28%) | 25.0 ml |
| Sodium ethylenediaminetetraacetato ferrote | 130.0 g |
| Glacial acetic acid | 14.0 ml |
| Water to make | 1.0 liter |
| Fix liquid: | |
| Sodium tetrapolyphosphate | 2.0 g |
| Sodium sulfite | 4.0 g |
| Ammonium thiosulfate (70%) | 175.0 ml |
| Sodium hydrogensulfite | 4.6 g |
| Water to make | 1.0 liter |
| Stabilization liquid: | |
| Formalin | 8.0 ml |
| Water to make | 1.0 liter |

TABLE 1

| Sample | Fog | Relative Sensitivity* | Maximum Cyan Coloring Density |
|---|---|---|---|
| 101 (Comparative Example) | 0.05 | 100 | 1.57 |
| 102 (Comparative Example) | 0.06 | 105 | 1.58 |
| 103 (Comparative Example) | 0.08 | 144 | 1.59 |
| 104 (Comparative Example) | 0.10 | 120 | 2.59 |
| 105 (This Invention) | 0.15 | 152 | 3.81 |

*Relative value in the case of defining the sensitivity of Sample 101 as 100.

From the results shown above, it can be seen that Sample 105 of this invention shows a high sensitivity and/or high coloring property as compared with Samples 101 to 103 using conventional couplers and also showing a high sensitivity and high coloring property as compared with Sample 104 using no hue-fixing compound as in this invention.

EXAMPLE 2

For evaluating the effectivity of the couplers and compounds of this invention, Sample 201 was prepared by coating the following layers of a baryta-coated paper support

Sample 201

| | |
|---|---|
| Silver halide emulsion layer: | |
| A layer containing: | |
| Negative-working silver chlorobromide emulsion (a monodispersed emulsion containing 50 mole % silver chloride, having a mean grain size of 0.5 μm, and containing silver halide grains of grain sizes within the mean grain size ± 40% at a proportion of more than 90% the whole silver halide grains | 0.42 g/m$^2$ |
| Sensitizing dye VIII | 5 × 10$^{-4}$ mole per mole of Ag |
| Yellow coupler Cp-10 | 0.40 g/m$^2$ |
| High-boiling organic solvent 0-3 | 0.20 g/m$^2$ |
| Gelatin | 2.0 g/m$^2$ |
| Protective layer: A layer containing: | |
| Gelatin | 1.3 g/m$^2$ |
| 2,4-Dichloro-6-hydroxy-s-triazine sodium salt | 50 mg/m$^2$ |

Samples 202 and 203

Samples 202 and 203 were prepared in the same manner as Sample 201 except that each of yellow coupler Cp-11 and Coupler Y-11 of this invention, respectively, was used in place of yellow coupler Cp-10 in Sample 201.

Samples 204 to 206

Samples 204 to 206 were prepared in the same manner as Samples 201 to 203, respectively, except that compound E-3 of this invention was dispersed in each silver halide emulsion together with high boiling organic solvent 0-3 containing each coupler used for Samples 201 to 203 so that the coating amount of compound E-3 became 0.2 g/m$^2$.

Each of the samples thus prepared was exposed for sensitometry and then subjected to the following color photographic processing.

| | Time | Temperature |
|---|---|---|
| 1. Color development | 3 min. 30 sec. | 33° C. |
| 2. Blix | 1 min. 30 sec. | 33° C. |
| 3. Wash | 2 min. 30 sec. | 25 to 30° C. |

The composition of the processing liquids used for the above processing were as follows.

| | |
|---|---|
| Color developer: | |
| Benzyl alcohol | 15 ml |
| Diethylene glycol | 8 ml |
| Ethylenediaminetetraacetic acid | 5 g |
| Sodium sulfite | 2 g |
| Anhydrous potassium carbonate | 30 g |
| Hydroxylamine sulfate | 3 g |
| Potassium bromide | 0.6 g |
| 4-Amino-N—ethyl-N—(β-methanesulfonamidoethyl)-m-toluidine 3/2 sulfate. monohydrate | 5 g |

-continued

| | |
|---|---|
| Water to make | 1 liter |
| pH adjusted to | 10.20 |
| Blix liquid: | |
| Ethylenediaminetetraacetic acid | 2 g |
| Ethylenediaminetetraacetic acid ferric salt | 40 g |
| Sodium sulfite | 5 g |
| Ammonium thiosulfate | 70 g |
| Water to make | 1 liter |

TABLE 2

| Sample | Coupler | Hue-fixing compound | Fog | Relative Sensitivity* | Maximum density |
|---|---|---|---|---|---|
| 201 (Comparison example) | Cp-10 | — | 0.03 | 100 | 1.57 |
| 202 (Comparison example) | Cp-11 | — | 0.03 | 93 | 1.55 |
| 203 (Comparison example) | Y-11 | — | 0.10 | 110 | 1.74 |
| 204 (Comparison example) | Cp-10 | E-3 | 0.04 | 103 | 1.58 |
| 205 | Cp-11 | E-3 | 0.03 | 95 | 1.55 |
| 206 (This invention) | Y-11 | E-3 | 0.12 | 120 | 3.02 |

*The relative value in the case of defining the sensitivity of Sample 201 as 100

From the results shown in Table 2, it can be seen that Sample 206 of this invention shows a very high coloring property as compared with Comparison Samples 201 to 205.

EXAMPLE 3

For evaluating the effectivity of the couplers and compounds of this invention, Samples 301 was prepared by coating the following layers on a transparent cellulose triacetate film support having a subbing layer.

Sample 301

| | |
|---|---|
| Silver halide emulsion layer: A layer containing: | |
| Negative-working silver iodobromide emulsion (tabular silver halide grains containing 5 mole % silver iodide and having a mean thickness of 0.15 μm and an aspect ratio of 7:1) | 0.35 g/m$^2$ |
| Yellow coupler Y-17 | 0.70 g/m$^2$ |
| High-boiling organic solvent 0-2 | 0.6 g/m$^2$ |
| Gelatin | 3.5 g/m$^2$ |
| First protective layer: A layer containing: | |
| Gelatin | 0.8 g/m$^2$ |
| Second protective layer: A layer containing: | |
| Gelatin | 0.7 g/m$^2$ |
| Polymethyl methacrylate particles (diameter: 1.5 μm) | 0.15 g/m$^2$ |
| 2,4-Dichloro-6-hydroxy-s-triazine Sodium salt | 50 mg/m$^2$ |

Sample 302

Sample 302 was prepared in the same manner as Sample 301 except that 0.20 g/m$^2$ of water-dispersible mordant P-13 was added to the silver halide emulsion layer of Sample 301.

Sample 303

Sample 303 was prepared in the same manner as Sample 301 except that 0.20 g/m$^2$ of water-dispersible mordant P-13 was added to the 1st protective layer of Sample 301.

Each of the samples thus prepared was exposed for sensitometry and subjected to the following color photographic processing as shown below. The results obtained are shown in Table 3 below.

| Color photographic processing (38° C.) | |
|---|---|
| 1. First development | 6 min. |
| 2. Wash | 2 min. |
| 3. Reversal | 2 min |
| 4. Color development | 6 min. |
| 5. Compensation | 2 min. |
| 6. Bleach | 6 min. |
| 7. Fix | 4 min. |
| 8. Wash | 4 min. |
| 9. Stabilization | (Room temperature) |
| 10. Drying | |

The compositions of the processing liquids used for the above processing were as follows.

| | |
|---|---|
| First developer: | |
| Penta-sodium nitrilo-N,N,N—trimethylenephosphonate | 3 g |
| Sodium sulfite | 20 g |
| Hydroquinone monosulfonate | 30 g |
| Sodium carbonate (mono-hydrate) | 30 g |
| 1-Phenyl-4-methyl-4-hydroxymethyl-3-pyrazolidone | 2 g |
| Potassium bromide | 2.5 g |
| Potassium thiocyanate | 1.2 g |
| Potassium iodide (0.1% solution) | 2 ml |
| Water to make | 1.0 liter |
| Reversal liquid: | |
| Water | 700 ml |
| Penta-sodium nitrilo-N,N,N—trimethylenephosphonate | 3 g |
| Stannous chloride (di-hydrate) | 1 g |
| p-Aminophenol | 0.1 g |
| Sodium hydroxide | 8 g |
| Glacial acetic acid | 15 ml |
| Water to make | 1.0 liter |
| Color developer: | |
| Water | 700 ml |
| Penta-sodium nitrilo-N,N,N—trimethylenephosphonate | 3 g |
| Sodium sulfite | 7 g |
| Sodium tertiary phosphate (12-hydrate) | 36 g |
| Potassium bromide | 1 g |
| Potassium iodide (0.1% solution) | 90 ml |
| Sodium hydroxide | 3 g |
| Citrazinic acid | 1.5 g |
| N—Ethyl-N—(β-methanesulfonamidoethyl)-3-methyl-4-aminoaniline sulfate | 11 g |
| Ethylenediamine | 3 g |
| Water to make | 1.0 ml |
| Compensation liquid: | |
| Water | 700 ml |
| Ethylenediaminetetraacetic acid sodium salt (di-hydrate) | 8 g |
| Thioglycerol | 0.4 ml |
| Glacial acetic acid | 3 ml |
| Water to make | 1.0 liter |
| Bleach liquid: | |
| Water | 800 g |
| Ethylenediaminetetraacetic acid sodium salt (di-hydrate) | 2.0 g |
| Ammonium ethylenediaminetetraacetato dihydrate ferrate dihydrate | 120.0 g |
| Potassium bromide | 100.0 g |
| Water to make | 1.0 liter |

-continued

| | |
|---|---|
| Fix liquid: | |
| Water | 800 ml |
| Ammonium thiosulfate | 80.0 g |
| Sodium sulfite | 5.0 g |
| Sodium hydrogensulfite | 5.0 g |
| Water to make | 1.0 liter |
| Stabilization liquid: | |
| Water | 800 ml |
| Formalin (37 wt %) | 5.0 ml |
| Fuji Driwel (trade name, made by Fuji Photo Film Co., Ltd.) | 5.0 ml |
| Water to make | 1.0 liter |

TABLE 3

| Sample | Fog | Relative Sensitivity* | Maximum Cyan Coloring Density |
|---|---|---|---|
| 301 (Comparison Example) | 0.12 | 100 | 2.02 |
| 302 (This Invention) | 0.13 | 105 | 3.01 |
| 303 (This Invention | 0.13 | 107 | 3.05 |

*Relative value in the case of defining the sensitivity of sample 301 as 100.

From the results shown in Table 3, it can be seen that Samples 302 and 303 of this invention show very high coloring property.

EXAMPLE 4

For evaluating the effectivity of the couplers and compounds of this invention, multilayer color photographic sample 401 having the following layers on a cellulose triacetate film support was prepared.

Sample 401

| | |
|---|---|
| Layer 1: Antihalation layer: A gelatin layer containing: | |
| Black colloid silver | 0.15 g/m$^2$ |
| Ultraviolet absorbent UV-1 | 0.10 g/m$^2$ |
| Ultraviolet absorbent UV-2 | 0.14 g/m$^2$ |
| High-boiling organic solvent O-1 | 0.04 g/m$^2$ |
| Layer 2: Interlayer: A gelatin layer containing: | |
| 2,5-Di-t-pentadecyl hydroquinone | 0.15 g/m$^2$ |
| Coupler Cp-1 | 0.05 g/m$^2$ |
| High-boiling organic solvent | 0.01 g/m$^2$ |
| Layer 3: 1st Red-sensitive emulsion layer: A gelatin layer containing: | |
| Silver iodobromide emulsion (silver iodide: 4 mole %; mean grain size: 0.4 μm) | 1.39 g/m$^2$ |
| Sensitizing dye I | 1.0 × 10$^{-5}$ mole per mole of Ag |
| Sensitizing dye II | 2.5 × 10$^{-5}$ mole per mole of Ag |
| Sensitizing dye III | 3.5 × 10$^{-5}$ mole per mole of Ag |
| Sensitizing dye IV | 2.2 × 10$^{-4}$ mole per mole of Ag |
| Coupler Cp-2 | 0.45 g/m$^2$ |
| Coupler Cp-3 | 0.03 g/m$^2$ |
| High-boiling organic solvent | 0.50 g/m$^2$ |
| Layer 4: 2nd Red-sensitive emulsion layer: A gelatin layer containing: | |
| Silver iodobromide emulsion (silver iodide: 8 mole %; mean grain size: 0.9 μm) | 0.92 g/m$^2$ |
| Sensitizing dye I | 7.0 × 10$^{-5}$ mole per mole of Ag |
| Sensitizing dye II | 2.0 × 10$^{-5}$ mole per mole of Ag |
| Sensitizing dye III | 2.8 × 10$^{-4}$ mole per mole of Ag |
| Sensitizing dye IV | 2.0 × 10$^{-5}$ mole per mole of Ag |
| Coupler Cp-2 | 0.015 g/m$^2$ |
| Coupler Cp-3 | 0.030 g/m$^2$ |
| Coupler Cp-4 | 0.060 g/m$^2$ |
| High-boiling organic solvent O-2 | 0.30 g/m$^2$ |
| Layer 5: Interlayer: A gelatin layer containing: | |
| 2,5-Di-t-octylhydroquinone | 0.03 g/m$^2$ |
| High-boiling organic solvent O-2 | 0.06 g/m$^2$ |
| Layer 6: 1st Green-sensitive emulsion layer: A gelatin layer containing: | |
| Silver iodobromide emulsion (silver-iodide: 5 mole %; mean grain size: 0.4 μm) | 0.78 g/m$^2$ |
| Sensitizing dye V | 2.2 × 10$^{-4}$ mole per mole of Ag |
| Sensitizing dye VI | 4.5 × 10$^{-4}$ mole per mole of Ag |
| Coupler Cp-5 | 0.55 g/m$^2$ |
| Coupler Cp-1 | 0.10 g/m$^2$ |
| Coupler Cp-6 | 0.008 g/m$^2$ |
| Coupler Cp-7 | 0.043 g/m$^2$ |
| High-boiling organic solvent O-3 | 0.60 g/m$^2$ |
| Layer 7: 2nd Green-sensitive emulsion layer: A gelatin layer containing: | |
| Silver iodobromide emulsion (silver iodide: 7 mole %; mean grain size: 0.8 μm) | 0.81 g/m$^2$ |
| Sensitizing dye V | 0.9 × 10$^{-4}$ mole per mole of Ag |
| Sensitizing dye VI | 1.9 × 10$^{-4}$ mole per mole of Ag |
| Coupler Cp-8 | 0.075 g/m$^2$ |
| Coupler Cp-1 | 0.030 g/m$^2$ |
| High-boiling organic solvent O-2 | 0.30 g/m$^2$ |
| Layer 8: Yellow filter layer: A gelatin layer containing: | |
| Yellow colloid silver | 0.08 g/m$^2$ |
| 2,5-Di-t-octylhydroquinone | 0.13 g/m$^2$ |
| Layer 9: 1st Blue-sensitive emulsion layer: A gelatin layer containing: | |
| Silver iodobromide emulsion (silver iodide: 5 mole %; mean grain size: 0.5 μm) | 0.35 g/m$^2$ |
| Coupler Cp-9 | 0.71 g/m$^2$ |
| Coupler Cp-7 | 0.07 g/m$^2$ |
| Sensitizing dye VII | 5.0 × 10$^{-4}$ mole per mole of Ag |
| High-boiling organic solvent O-2 | 0.26 g/m$^2$ |
| Layer 10: 2nd Blue-sensitive emulsion layer: A gelatin layer containing: | |
| Silver iodobromide emulsion (silver iodide: 9 mole %; mean grain size: 0.7 μm) | 0.53 g/m$^2$ |
| Coupler Cp-9 | 0.23 g/m$^2$ |
| Sensitizing dye VII | 2.5 × 10$^{-4}$ mole per mole of Ag |
| High-boiling organic solvent O-2 | 0.08 g/m$^2$ |
| Layer 11: 1st Protective layer: A gelatin layer containing: | |
| Silver iodobromide emulsion (silver iodide: 1 mole %; mean grain size: 0.07 μm) | 0.2 g/m$^2$ |
| Ultraviolet absorbent UV-1 | 0.07 g/m$^2$ |
| Ultraviolet absorbent UV-2 | 0.20 g/m$^2$ |
| High-boiling organic solvent O-1 | 0.043 g/m$^2$ |
| Layer 12: 2nd Protective layer: A gelatin layer containing: | |
| Polymethyl methacrylate particles diameter: 1.5 μm) | 0.15 g |

Each of the above-described layers containing hardening agent H-1 and a surface active agent in addition to the aforesaid components.

Thus, Sample 401 was prepared.

Sample 402

The same procedure as the case of preparing Sample 401 was followed except that coupler Cp-9 in layer 9 of Sample 401 was replaced by coupler Y-2 of this invention releasing a yellow dye by causing cleavage and further hue-fixing compound E-7 of this invention was further added thereto in an equimolar amount to coupler Y-2. When the sample was subjected to the color photographic processing as for Sample 2 described above, the yellow density was greatly increased as compared to that of Sample 401. Thus, Sample 402 was prepared by following the same procedure as the case of preparing Sample 401 except that each of coupler Y-2 and compound E-71 was added in an amount of ½ mole of coupler Cp-9 for matching the gradation thereof with that Sample 401 and the amounts of the high-boiling organic solvent for dispersion and gelatin were reduced with the addition of the aforesaid coupler and compound (the amount of the high-boiling organic solvent was reduced to ½ of the original coating amount and the amount of gelatin was reduced from 1.0 g/m$^2$ to 0.65 g/m$^2$).

Each of these samples 401 and 402 was exposed and subjected to the above-described color photographic processing and the MTF value of the 1st blue-sensitive emulsion layer at the spatial frequency of 40 lines per mm was measured. The results are shown in Table 4 below.

The measurement method for MTF is described in T. H. James, *The Theory of the Photographic Process,* 4th Edition, pages 604–607 (published by MacMillan Co., 1977).

TABLE 4

| Sample | Yellow coupler | MTF value (yellow dye image) |
|---|---|---|
| 401 (Comparison example) | Cp-9 | 0.55 |
| 402 | Y-2 | 0.59 |

From the results shown in Table 4, it can be seen that Sample 402 of this invention shows improved MTF as compared with Comparison Sample 401.

The structures of the compounds other than the compounds of this invention shown in the above examples are shown below.

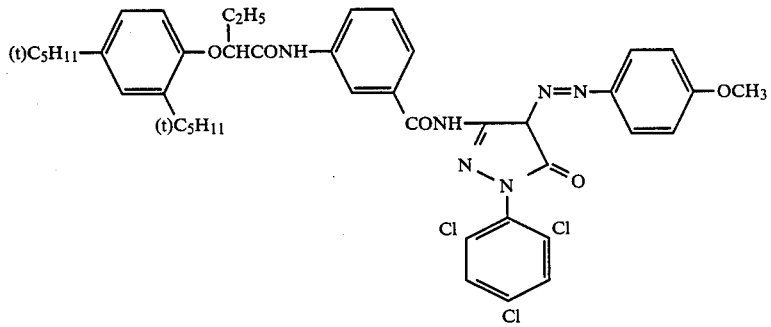

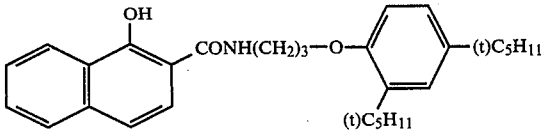

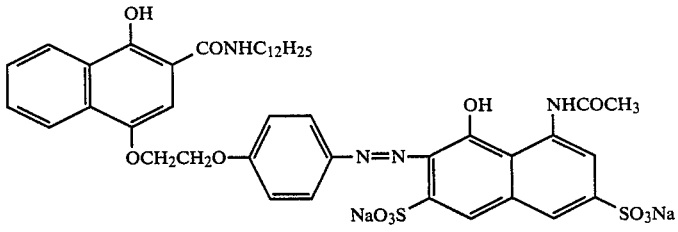

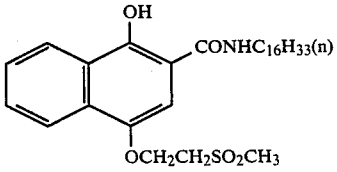

-continued
Cp-5
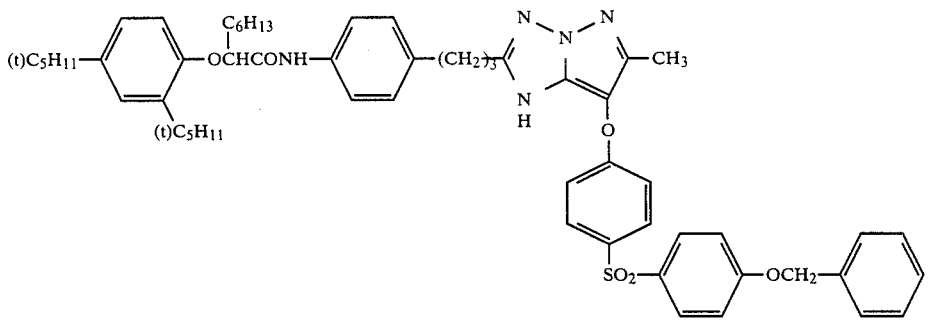
Cp-6
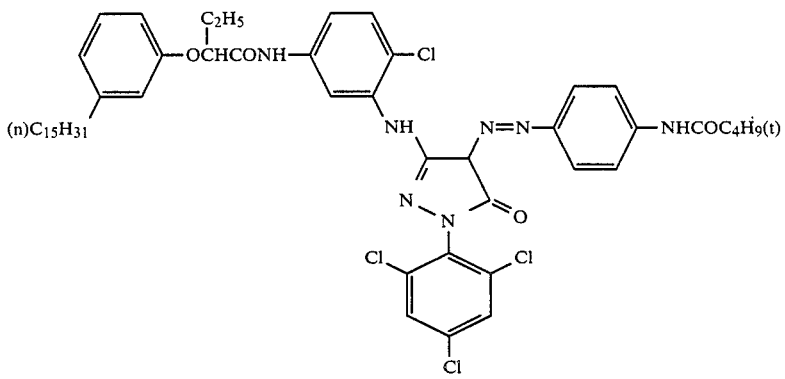
Cp-7
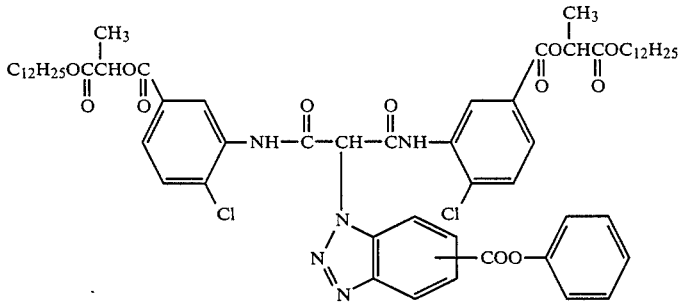
Cp-8
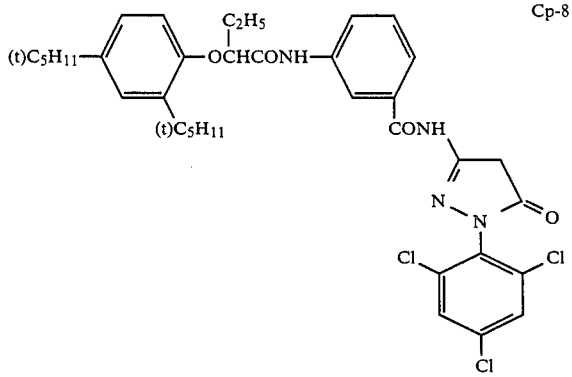
Cp-9
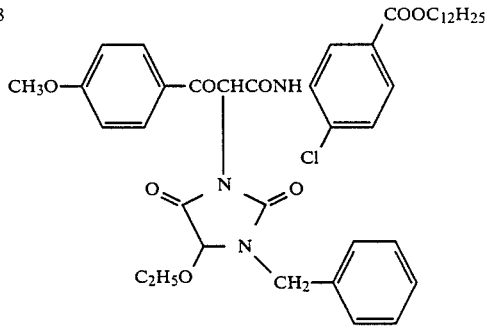

-continued
Cp-10
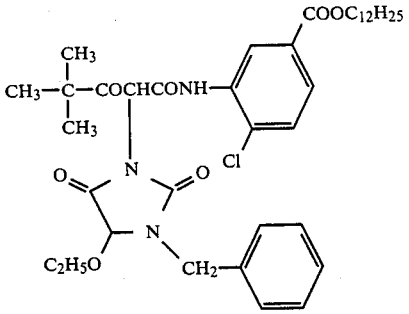
Cp-11
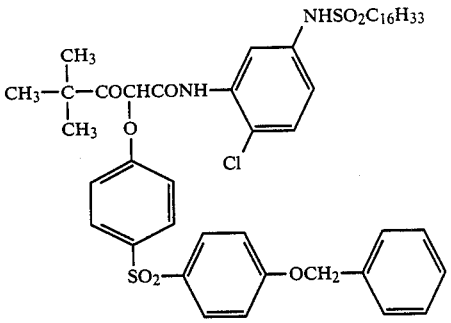
$(n\text{-}C_6H_{13}O)_3P{=}O$
O-1
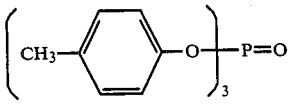
O-2
$C_{11}H_{23}CON(C_2H_5)_2$
O-3
$(CH_2{=}CHSO_2CH_2CONHCH_2)_2$
H-1
Sensitizing Dye I
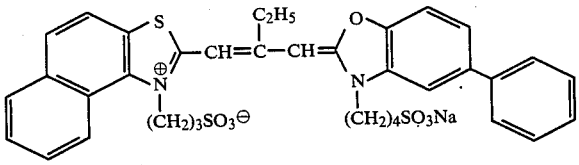
Sensitizing Dye II
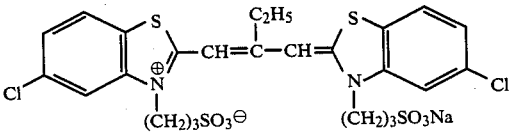
Sensitizing Dye III
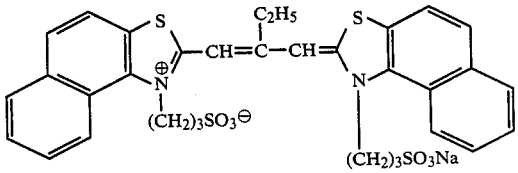
Sensitizing Dye IV
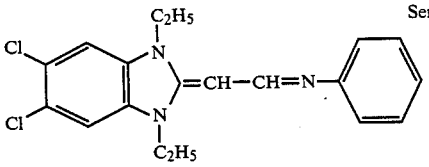
Sensitizing Dye V
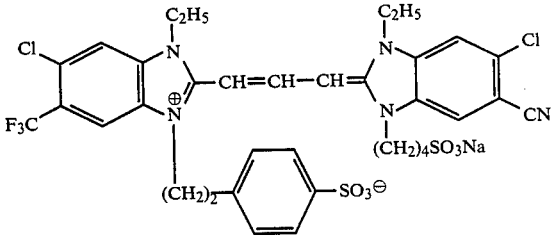
Sensitizing Dye VI
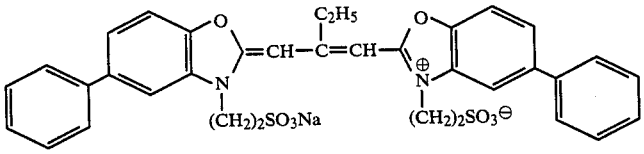
Sensitizing Dye VII
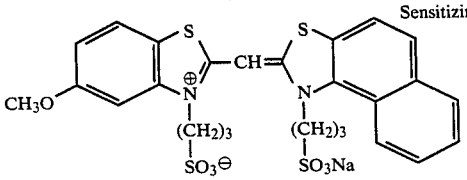
Sensitizing Dye VIII
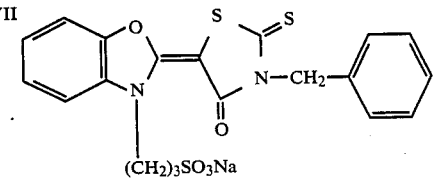

-continued

UV-1

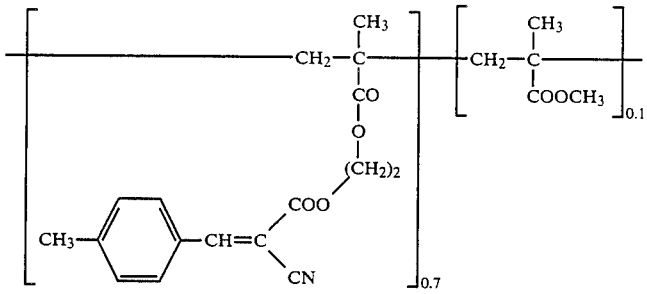

Average molecular weight: about 20,000

UV-2

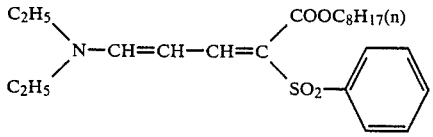

While the invention has been described in detail and with reference to specific embodiments thereof, it will be apparent to one skilled in the art that various changes and modifications can be made therein without departing from the spirit and scope thereof.

What is claimed is:

1. A conventional silver halide color photographic material containing a coupler having a dye moiety having the maximum absorption wave length shifted to a short wave length by a linkage which is cleaved directly or through a timing group by a coupling reaction with the oxidation product of a developing agent and forming a compound or the precursor thereof (compound A) having a dye moiety having a maximum absorption wave length before shifting as the result of the above-described reaction and a compound (dye-fixing compound) capable of fixing the hue of said compound A at a long wave length or capable of immobilizing said compound A in the photographic layer, or both.

2. The conventional silver halide color photographic material as claimed in claim 1, wherein the hue of said compound A is substantially the same as the hue of dye formed by coupling reaction between said coupler and the oxidation product of aromatic primary amine developing agent.

3. The conventional silver halide color photographic material as claimed in claim 1, wherein said coupler is represented by the following general formula (I)

$$Cp—(TIME)_{\bar{n}}X—Dye \quad (I)$$

wherein, Cp represents a coupler residue capable of releasing —(TIME)$_{\bar{n}}$X—Dye by the coupling reaction with the oxidation product of an aromatic primary amine developing agent; TIME represents a timing group; Dye represents a dye residue; X represents an auxochrome for said dye; and n represents 0 or a positive integer.

4. The conventional silver halide color photographic material as claimed in claim 1, wherein the difference between the maximum absorption wave length before shifting and that after shifting is more than 20 nm.

5. The conventional silver halide color photographic material as claimed in claim 4, wherein the difference between the maximum absorption wave length before shifting and that after shifting is more than 40 nm.

6. The conventional silver halide color photographic material as claimed in claim 3, wherein when $n \geqq 1$, the timing group shown by TIME is a divalent or tri-valent organic group for linking the coupling portion of Cp and —X—Dye and when n=0, —X—Dye is bonded to the coupling portion of Cp.

7. The conventional silver halide color photographic material as claimed in claim 3, wherein X is selected from the group consisting of an oxygen atom, a nitrogen atom and a sulfur atom.

8. The conventional silver halide color photographic material as claimed in claim 3, wherein —X—Dye is selected from the group consisting of hydroxy group-substituted aromatic azo dyes and hydroxy group-substituted heterocyclic aromatic azo dyes represented by the following general formula (II)

$$—X—Y—N{=}N—Z \quad (II)$$

wherein X has the same significance as defined in the general formula (I); Y represents an atomic group which contains at least one unsaturated bond in a conjugated relation with the azo group and is bonded to X at the atom constituting the unsaturated bond; and Z represents an atomic group containing at least one unsaturated bond capable of being conjugated with the azo group; the total carbon atoms contained in said Y and Z being more than 10.

9. The conventional silver halide color photographic material as claimed in claim 8, wherein X is selected from the group consisting of an oxygen atom and a sulfur atom.

10. The conventional silver halide color photographic material as claimed in claim 8, wherein Y and Z each is selected from the group consisting of aromatic groups and unsaturated heterocyclic ring groups.

11. The conventional silver halide color photographic material as claimed in claim 10, wherein said aromatic groups are selected from the group consisting of substituted or unsubstituted phenyl groups and naphthyl groups.

12. The conventional silver halide color photographic material as claimed in claim 10, wherein said unsaturated heterocyclic ring groups represent groups having a cyclic structure selected from the group consisting of pyrrole, thiophene, furan, imidazole, 1,2,4-triazole, oxazole, thiadiazole, pyridine, indole, benzothiophene, benzimidazole and benzoxazole.

13. The conventional silver halide color photographic material as claimed in claim 10, wherein a substituent of Y group is selected from the group consisting of an aliphatic group, an aromatic group, an acyl group, an alkoxycarbonyl group, an aryloxycarbonyl group, an acylamino group, an alkylthio group, an arylthio group, a heterocyclic ring group, a sulfonyl group, a halogen atom, a nitro group, a nitroso group, a cyano group, a carboxy group, a hydroxy group, a sulfonamido group, an alkoxy group, an aryloxy group, an acyloxy group, a carbamoyl group, an amino group, a ureido group, a sulfamoyl group, a carbamoylsulfonyl group and a hydrazinyl group.

14. The conventional silver halide color photographic material as claimed in claim 10, wherein a substituent of Z group is selected from the group consisting of an aliphatic group, an aromatic group, an acyl group, an alkoxycarbonyl group, an aryloxycarbonyl group, an acylamino group, an alkylthio group, an arylthio group, a heterocyclic ring group, a sulfonyl group, a halogen atom, a nitro group, a nitroso group, a cyano group, a carboxy group, a hydroxy group, a sulfonamido group, an alkoxy group, an aryloxy group, an acyloxy group, a carbamoyl group, an amino group, a ureido group, a sulfamoyl group, a carbamoylsulfonyl group and a hydrazinyl group.

15. The conventional silver halide color photographic material as claimed in claim 13, wherein said aliphatic group moiety represents a substituted or unsubstituted, saturated or unsaturated, straight chain or branched, or chain-form or cyclic group having 1 to 32 carbon atoms.

16. The conventional silver halide color photographic material as claimed in claim 14, wherein said aliphatic group moiety represents a substituted or unsubstituted, saturated or unsaturated, straight chain or branched, or chain-form or cyclic group having 1 to 32 carbon atoms.

17. The conventional silver halide color photographic material as claimed in claim 13, wherein said aromatic group moiety has 6 to 10 carbon atoms.

18. The conventional silver halide color photographic material as claimed in claim 14, wherein said aromatic group moiety has 6 to 10 carbon atoms.

19. The conventional silver halide color photographic material as claimed in claim 8, wherein said dye shown by the general formula (II) is selected from the group consisting of those represented by the following general formulae:

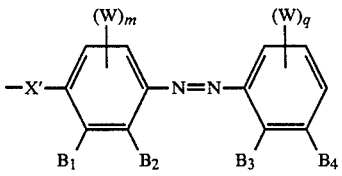

(D-1)

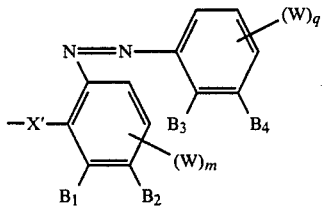

(D-2)

-continued

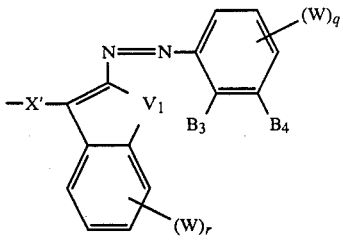

(D-3)

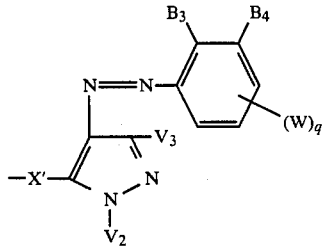

(D-4)

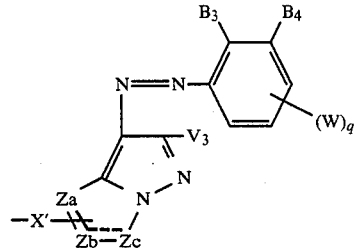

(D-5)

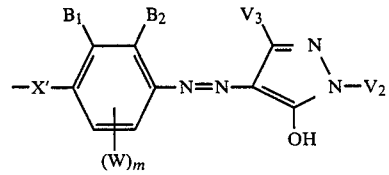

(D-6)

wherein X' represents an oxygen atom or a sulfur atom; W represents an aliphatic group, an aromatic group, an acyl group, an alkoxycarbonyl group, an aryloxycarbonyl group, an acylamino group, an alkylthio group, an arylthio group, a heterocyclic ring group, a sulfonyl group, a halogen atom, a nitro group, a nitroso group, a cyano group, a carboxy group, a hydroxy group, a sulfonamido group, an alkoxy group, an aryloxy group, an acyloxy group, a carbamoyl group, an amino group, a ureido group, a sulfamoyl group, a carbamoylsulfonyl group or a hydrazinyl group; m represents 0, 1 or 2; q represents 0, 1, 2 or 3; r represents 0 or an integer of 1 to 4; $B_1$, $B_2$, $B_3$ and $B_4$ each represents a hydrogen atom or the groups defined as W group or the $B_1$ and $B_2$ or the $B_3$ and $B_4$ combine with each other to form a benzene condensed ring; $V_1$ represents an oxygen atom, a sulfur atom, or an imino group; $V_2$ represents an aliphatic hydrocarbon residue, an aryl group, or a heterocyclic ring residue; $V_3$ represents a straight chain or branched alkyl group having 1 to 32 carbon atoms, an alkenyl group, a cyclic alkyl group, an aralkyl group, a cyclic alkenyl group, an aryl group, a heterocyclic ring group, an alkoxycarbonyl group, an aryloxycarbonyl group, an aralkyloxycarbonyl group, an alkoxy group, an aryloxy group, an acylamino group, a diacylamino group, an N-alkylacylamino group, an N-arylamylamino group, a ureido group, an alkylamino group, a cycloamino group, or a sulfonamido group, a halogen atom or a cyano group; and Za, Zb and Zc each represents methine, substituted methine, =N— or —NH—, one of a Za-Zb bond and a Zb-Zc bond is a double bond and the other is a single bond, and any one of Za, Zb and Zc is bonded to X' to form —X'—C=, or the Zb-Zc bond which is a carbon-carbon double bond forms a part of an aromatic ring with proviso that Za, Zb and Zc are simultaneously N.

20. The conventional silver halide color photographic material as claimed in claim 3, wherein Cp is selected from the group consisting of coupler residues represented by the following general formula (III), (IV), (V), (VI), (VII), (VIII), (IX), (X), (XI), (XII), or (XIII).

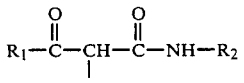
(III)

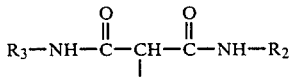
(IV)

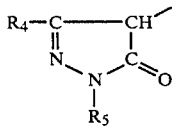
(V)

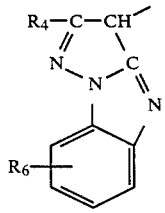
(VI)

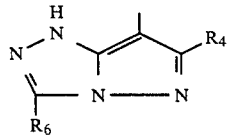
(VII)

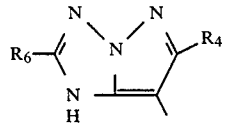
(VIII)

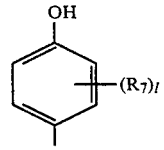
(IX)

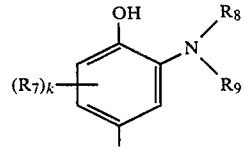
(X)

-continued

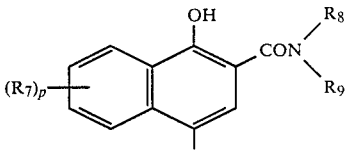
(XI)

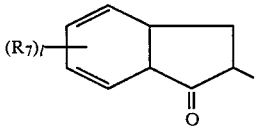
(XII)

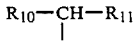
(XIII)

wherein each free bonding hand disposing at the coupling position shows a bonding position of a coupling releasing group; the total carbon atom numbers of $R_1$, $R_2$, $R_3$, $R_4$, $R_5$, $R_6$, $R_7$, $R_8$, $R_9$, $R_{10}$ or $R_{11}$ which has a non-diffusible group are 8 to 32 and the total carbon atom numbers of $R_1$, $R_2$, $R_3$, $R_4$, $R_5$, $R_6$, $R_7$, $R_8$, $R_9$, $R_{10}$ or $R_{11}$ which has a group other than the non-diffusible group are 15 or less; $R_1$ represents an aliphatic group, an aromatic group, an alkoxy group or a heterocyclic group; $R_2$ and $R_3$ each represents an aromatic group or a heterocyclic group; $R_5$ represents a straight chain or branched alkyl group having 1 to 32 carbon atoms, an alkenyl group, a cyclic alkyl group, an aralkyl group, a cyclic alkenyl group, an aryl group, a heterocyclic ring, an aliphatic acyl group, an aromatic acyl group, an alkylsulfonyl group, an arylsulfonyl group, an alkylcarbamoyl group, an arylcarbamoyl group, an alkylthiocarbamoyl group, or an arylthiocarbamoyl group; $R_4$ represents a hydrogen atom, a straight chain or branched alkyl group having 1 to 32 carbon atoms, an alkenyl group, a cyclic alkyl group, an aralkyl group, a cyclic alkenyl group, an alkoxycarbonyl group, an aryloxycarbonyl group, an aralkyloxycarbonyl group, an alkoxy group, an aryloxy group, an alkylthio group, an arylthio group, a carboxy group, an acylamino group, a diacylamino group, an N-alkylacylamino group, an N-arylacylamino group, a uredio group, a urethane group, a thiourethane group, an arylamino group, an alkylamino group, a cycloamino group, a heterocy-clic amino group, an alkylcarbonyl group, an arylcarbonyl group, a sulfonamido group, a carbamoyl group, a sulfamoyl group, a cyano group, a hydroxy group, a mercapto group, a halogen atom or a sulfo group; $R_6$ represents a hydrogen atom, a straight chain or branched alkyl group having 1 to 32 carbon atoms, an alkenyl group, a cyclic alkyl group, an aralkyl group, a cyclic alkenyl group, an aryl group, a heterocyclic group, a cyano group, an alkoxy group, an aryloxy group, a halogen atom, a carboxy group, an alkoxycarbonyl group, an aryloxycarbonyl group, an acyloxy group, a sulfo group, a sulfamoyl group, a carbamoyl group, an acylamino group, a diacylamino group, a ureido group, a urethane group, a sulfonamido group, an arylsulfonyl group, an alkylsulfonyl group, an arylthio group, an alkylthio group, an alkylamino group, a dialkylamino group, an anilino group, an N-acylanilino group, an N-alkylanilino group, an N-acylanilino group, a hydroxy group, or a mercapto group; $R_7$, $R_8$ and $R_9$ each represents a group usually used for four-equivalent phenol or α-naphthol coupler; l represents an integer of 1 to 4; k represents an integer of 1 to 3; p represents an integer of 1 to 5; $R_{10}$ represents an arylcarbonyl group, an alkanoyl group having 2 to 32 carbon atoms, an arylcarbamoyl group, an alkanecarbamoyl group having 2 to 32 carbon atoms, an alkoxycarbonyl group having 1 to 32 carbon atoms, or an aryloxycarbonyl group; and $R_{11}$ represents an arylcarbonyl group, an alkanoyl group having 2 to 32 carbon atoms, an arylcarbamoyl group, an alkanecarbamoyl group having 2 to 32 carbon atoms, an alkoxycarbonyl group having 1 to 32 carbon atoms, an aryloxycarbonyl group, an alkanesulfonyl group having 1 to 32 carbon atoms, an arylsulfonyl group, an aryl group, or a 5-membered or 6-membered heterocyclic group.

21. The conventional silver halide color photographic material as claimed in claim 3, wherein said coupler is selected from the group consisting of a polymer derived from a monomer coupler represented by the following general formula (XIV) and having a recurring unit represented by the general formula (XV). and a copolymer of at least one kind of the above-described monomer coupler and at least one of a non-coloring monomer having at least one ethylene group having no coupling ability with the oxidation product of an aromatic primary amine developing agent:

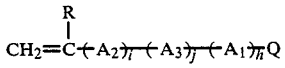

(XIV)

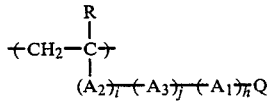

(XV)

wherein, R represents a hydrogen atom, a lower alkyl group having 1 to 4 carbon atoms or a chlorine atom; $A_1$ represents —CONH—, —NHCONH—, —NHCOO—, —COO—, —$SO_2$—, —CO—, —NHCO—, —$SO_2$NH—, —$NHSO_2$—, —OCO—, —OCONH—, —NH— or —O—; $A_2$ represents —CONH— or —COO—; $A_3$ represents a substituted or unsubstituted alkylene group having 1 to 10 carbon atoms, a substituted or unsubstituted aralkylene group, or a substituted or unsubstituted arylene group; Q represents a residue of the coupler shown by the general formula (I) and is bonded through any moiety of Cp, TIME or Dye in the general formula (I); and i, j, h represents 0 or 1 excluding the case that i, j, and h are simultaneously 0.

22. The conventional silver halide color photographic material as claimed in claim 21, wherein said non-coloring monomer having at least one ethylene group having no coupling ability with the oxidation product of an aromatic primary amine developing agent is selected from the group consisting of acrylic acid, α-chloroacrylic acid, α-alkylacrylic acid, the esters or amides derived from these acrylic acids, methylenebisacrylamide, vinyl ester, acrylonitrile, an aromatic vinyl compound, a maleic acid derivative, a vinylpyridine and the combinations thereof.

23. The conventional silver halide color photographic material as claimed in claim 20, wherein the coupler represented by the general formula (I) which has as Cp a coupler residue represented by the general formula (III) or (IV) forms the compound A having a maximum absorption wave length ranging from 400 nm. to 480 nm.; the coupler represented by the general formula (I) which has as Cp a coupler residue represented by the general formula (V), (VI), (VII) or (VIII) forms the compound A having a maximum absorption wave length ranging from 510 nm. to 590 nm.; and the coupler represented by the general formula (I) which has as Cp a coupler residue represented by the general formula (X) or (XI) forms the compound A having a maximum absorption wave length ranging from 600 nm. to 700 nm.

24. The conventional silver halide color photographic material as claimed in claim 23, wherein Cp is selected from the group consisting of coupler residues represented by the general formula (III), (IV), (X) or (XI).

25. The conventional silver halide color photographic material as claimed in claim 24, wherein Cp is selected from the group consisting of coupler residues represented by the general formula (III) or (IV).

26. The conventional silver halide color photographic material as claimed in claim 1, wherein said coupler is added to a light-sensitive silver halide emulsion layer or the adjacent layer thereof.

27. The conventional silver halide color photographic material as claimed in claim 3, wherein the addition amount of said coupler is 0.001 to 1 mole per mole of silver.

28. The conventional silver halide color photographic material as claimed in claim 27, wherein the addition amount of said coupler is 0.005 to 0.5 mole per mole of silver.

29. The conventional silver halide color photographic material as claimed in claim 1, wherein said dye fixing compound is selected from the group consisting of compounds represented by the following general formula (XVI) or (XVII):

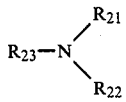

(XVI)

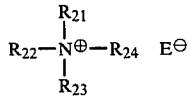

(XVII)

wherein, $R_{21}$ represents an aliphatic group, an aryl group, or a heterocyclic group; $R_{22}$, $R_{23}$ and $R_{24}$ each represents a hydrogen atom, an alkyl group or an aryl group, or $R_{22}$, $R_{23}$ and $R_{24}$ are condensed with each other to form a closed ring or each of them is condensed with $R_{21}$ to form a closed ring; the total sum of the carbon atoms contained in the compound shown in the general fromula (XVI) or (XVII) is at least 10; and $E^{\ominus}$ represents a halogen ion, a sulfuric acid ester ion, an alkyl or arylsulfonic acid ion, an acetic acid ion or a sulfuric acid ion.

30. The conventional silver halide color photographic material as claimed in claim 29, wherein $E^{\ominus}$ is selected from the group consisting of a chloride ion, an alkylsulfuric acid ion, an alkylsulfuric acid ion and an arylsulfuric acid ion.

* * * * *